US009744775B2

(12) United States Patent
Ookubo et al.

(10) Patent No.: US 9,744,775 B2
(45) Date of Patent: Aug. 29, 2017

(54) THERMAL HEAD AND THERMAL PRINTER

(71) Applicant: KYOCERA Corporation, Kyoto-shi, Kyoto (JP)

(72) Inventors: Yuuna Ookubo, Kirishima (JP); Yoichi Moto, Okaya (JP); Yui Tanaka, Muko (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/329,751

(22) PCT Filed: Jul. 29, 2015

(86) PCT No.: PCT/JP2015/071514
§ 371 (c)(1),
(2) Date: Jan. 27, 2017

(87) PCT Pub. No.: WO2016/017698
PCT Pub. Date: Feb. 4, 2016

(65) Prior Publication Data

US 2017/0217205 A1 Aug. 3, 2017

(30) Foreign Application Priority Data

Jul. 29, 2014 (JP) ..... 2014-153947

(51) Int. Cl.
*B41J 2/335* (2006.01)
*B41J 2/35* (2006.01)
*B41J 2/355* (2006.01)

(52) U.S. Cl.
CPC ..... *B41J 2/355* (2013.01)

(58) Field of Classification Search
CPC ... B41J 2/35; B41J 2/355; B41J 2/3551; B41J 2/3553; B41J 2/3555; B41J 2/3556; B41J 2/3558; B41J 2/33515; B41J 2/33505; B41J 2/33535; B41J 2/335; B41J 2/3355; B41J 2/345; B41J 2/33595
See application file for complete search history.

(56) References Cited

U.S. PATENT DOCUMENTS 6,184,913 B1 * 2/2001 Nagano ..... B41J 2/3355 347/203
6,579,125 B1 6/2003 Nagahata et al.
2004/0046857 A1 * 3/2004 Sato ..... B41J 2/335 347/203
2010/0085412 A1 * 4/2010 Kanei ..... B41J 2/33515 347/203

FOREIGN PATENT DOCUMENTS

JP 2000-173695 A 6/2000

OTHER PUBLICATIONS

International Search Report (Form PCT/ISA/210) issued for PCT/JP2015/071514, mailed on Oct. 13, 2015.
Written Opinion(Form PCT/ISA/237) issued for PCT/JP2015/071514, mailed on Oct. 13, 2015.

* cited by examiner

*Primary Examiner* — Kristal Feggins
(74) *Attorney, Agent, or Firm* — Volpe and Koenig, P.C.

(57) ABSTRACT

A thermal head includes a substrate; a plurality of heating elements; a plurality of electrodes; a first covering layer; and a covering member. The thermal head further includes a second covering layer extending from the first covering layer onto the end surface. The housing is in contact with the second covering layer.

16 Claims, 14 Drawing Sheets

THERMAL HEAD AND THERMAL PRINTER

TECHNICAL FIELD

The present invention relates to a thermal head and a thermal printer.

BACKGROUND ART

To date, various thermal heads have been developed as a printing device for a facsimile, a video printer, or the like. For example, a known thermal head includes a substrate having a first main surface and an end surface adjacent to the first main surface; a plurality of heating elements disposed on the first main surface or on the end surface; a plurality of electrodes disposed on the first main surface and electrically connected to the plurality of heating elements; and a connector including a plurality of connector pins disposed on the plurality of electrodes and a housing containing the plurality of connector pins, the connector being disposed adjacent to the end surface.

In the thermal head, the connector pins hold an edge portion of the substrate between the connector pins, and thereby the electrodes and the connector pins are electrically connected to each other and the connector is attached to the substrate. To improve electrical insulation or joint strength, the thermal head includes a covering member that covers the plurality of connector pins on the plurality of electrodes together with the plurality of electrodes (see PTL 1).

CITATION LIST

Patent Literature

PTL 1: Japanese Unexamined Patent Application Publication No. 2000-173695

SUMMARY OF INVENTION

Technical Problem

However, when inserting the substrate into the connector, the substrate may contact the connector pins and may break.

Solution to Problem

A thermal head according to an embodiment of the present invention includes a substrate having a first main surface and an end surface adjacent to the first main surface; a plurality of heating elements disposed on the first main surface or on the end surface; a plurality of electrodes disposed on the first main surface and electrically connected to the plurality of heating elements; a first covering layer disposed on parts of the plurality of electrodes; a connector disposed adjacent to the end surface and including a plurality of connector pins disposed on the plurality of electrodes and a housing containing the plurality of connector pins; and a covering member covering the plurality of connector pins on the plurality of electrodes together with the plurality of electrodes. The thermal head further includes a second covering layer extending from the first covering layer onto the end surface. The housing is in contact with the second covering layer.

A thermal printer according to an embodiment of the present invention includes the thermal head; a transport mechanism that transports a recording medium onto the heating elements; and a platen roller that presses the recording medium against the heating elements.

Advantageous Effects of Invention

With the present invention, the probability of breakage of the substrate can be reduced.

BRIEF DESCRIPTION OF DRAWINGS

FIG. 3A is a perspective view, and FIG. 3B is a partial enlarged perspective view.

FIG. 4A is a perspective view of a connector pin of the connector, FIG. 4B is a front view, and FIG. 4C is a rear view.

FIG. 5A is a plan view, and FIG. 5B is a bottom view.

FIG. 9A is a sectional view corresponding to FIG. 6A, and FIG. 9B is a sectional view corresponding to FIG. 6B.

FIG. 11A is a plan view, and FIG. 11B is a bottom view.

FIG. 13A is a sectional view corresponding to FIG. 6A, and FIG. 13B is a sectional view corresponding to FIG. 6B.

FIG. 14A is a sectional view corresponding to FIG. 6A, and FIG. 14B is a sectional view corresponding to FIG. 6B.

DESCRIPTION OF EMBODIMENTS

First Embodiment

Figure 1:
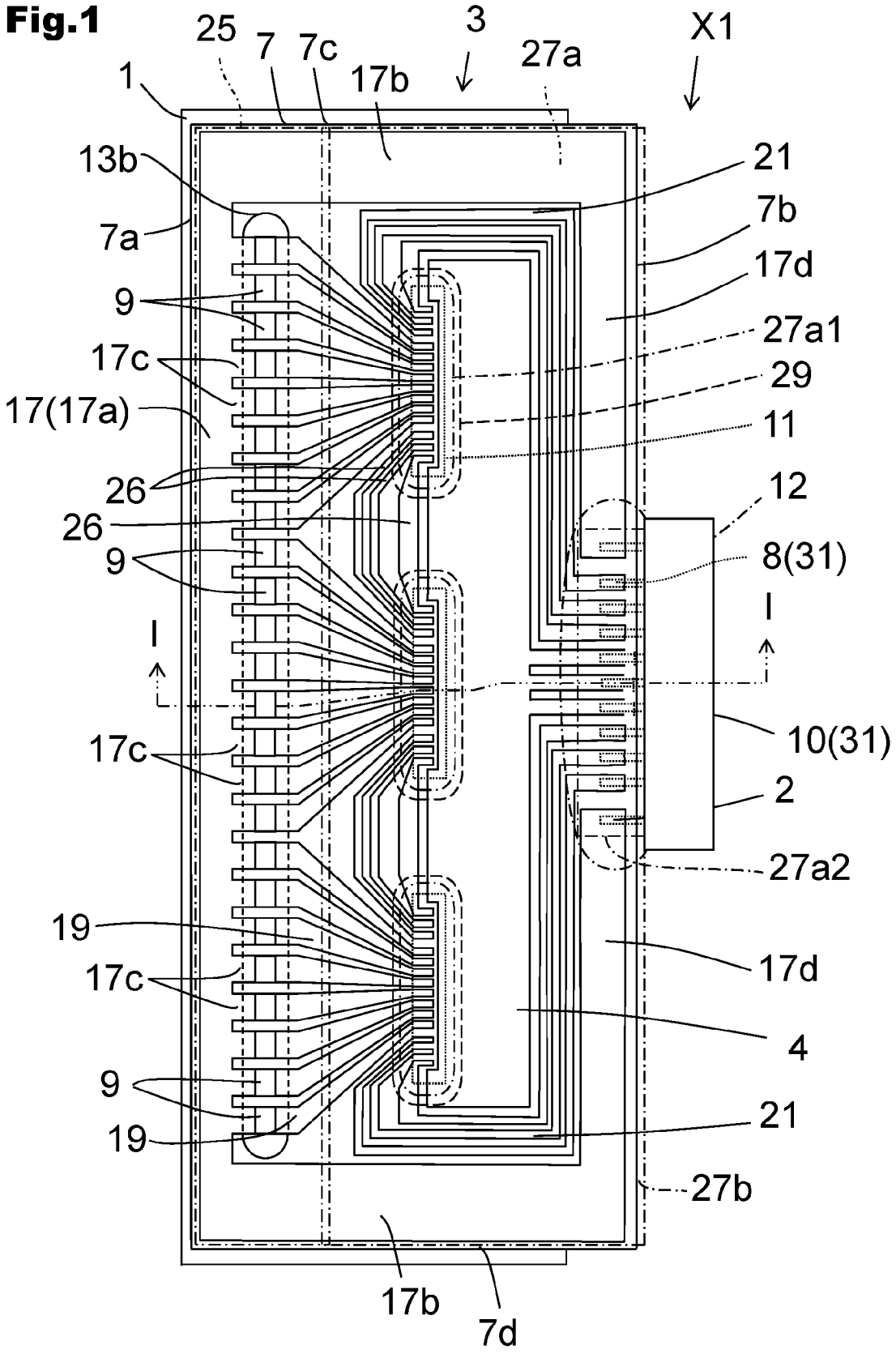
FIG. 1 is a plan view of a thermal head according to a first embodiment.

Hereinafter, a thermal head X1 will be described with reference to FIGS. 1 to 6. In FIG. 1, a protective layer 25, a covering layer 27, and a covering member 12 are omitted and shown by alternate long and short dash lines. In FIG. 1, the shape of the covering member 12 is simplified.

The thermal head X1 includes a heat sink 1, a head base body 3 disposed on the heat sink 1, and a connector 31 connected to the head base body 3.

i. The heat sink 1 is rectangular-parallelepiped-shaped. The heat sink 1 is made of, for example, a metal material, such as copper, iron, or aluminum. The heat sink 1 has a function of dissipating a part of heat that is generated by heating elements 9 of the head base body 3 and that does not contribute to printing. The head base body 3 is affixed to the upper surface of the heat sink 1 by using double-sided tape, an adhesive, or the like (not shown).

The head base body 3 is rectangular in plan view. Components of the thermal head X1 are disposed on a substrate 7 of the head base body 3. The head base body 3 has a function of performing printing on a recording medium P (see FIG. 7) in accordance with an electric signal supplied from the outside.

The connector 31 includes a plurality of connector pins 8 and a housing 10 that contains the plurality of connector pins 8. One part of each of the plurality of connector pins 8 is exposed to the outside of the housing 10, and the other part of each of the plurality of connector pins 8 is contained in the housing 10. The plurality of connector pins 8 have a function of electrically connecting various electrodes of the head base body 3 to a power source, which is disposed outside. The plurality of connector pins 8 are electrically insulated from each other. The housing 10 may be omitted.

Hereinafter, the components of the head base body 3 will be described.

The substrate 7 is disposed on the heat sink 1 and is rectangular in plan view. The substrate 7 has one long side 7*a*, the other long side 7*b*, one short side 7*c*, and the other short side 7*d*. The substrate 7 has an end surface 7*e* near the other long side 7*b* and a first main surface 7*f* on which the components of the thermal head X1 are disposed. The substrate 7 has a second main surface 7*j* on an opposite side to the first main surface 7*f*. The substrate 7 has a first corner 7*g* defined by the first main surface 7*f* and the end surface 7*e* of the substrate 7. The substrate 7 is made of, for example, an electrically insulating material, such as alumina ceramics, or a semiconductor material, such as single-crystal silicon.

A heat storage layer 13 is formed on the first main surface 7*f* of the substrate 7. The heat storage layer 13 includes a base portion 13*a* and a bulging portion 13*b*. The base portion 13*a* is formed on the left half of the first main surface 7*f* of the substrate 7. The base portion 13*a* is disposed near the heating elements 9 and below the protective layer 25 described below. The bulging portion 13*b* extends in a direction in which the plurality of heating elements 9 are arranged and has a substantially semielliptical cross section. The bulging portion 13*b* functions to appropriately press a recording medium P, on which printing is performed, against the protective layer 25 on the heating elements 9.

The heat storage layer 13, which is made of glass having low heat conductivity, temporarily stores a part of heat generated by the heating elements 9. Therefore, the time needed to increase the temperature of the heating elements 9 can be reduced, and the heat storage layer 13 functions to improve the thermal response characteristic of the thermal head X1. For example, the heat storage layer 13 can be formed by making a predetermined glass paste by mixing glass powder and an appropriate organic solvent, applying the glass paste to the first main surface 7*f* of the substrate 7 by using a known method, such as screen printing, and firing the glass paste.

A resistor layer 15 is disposed on an upper surface of the heat storage layer 13. Connection terminals 2, a ground electrode 4, a common electrode 17, individual electrodes 19, IC-connector connection electrodes 21, and IC-IC connection electrodes 26 are disposed on the resistor layer 15. The resistor layer 15 is patterned in the same shapes as the connection terminals 2, the ground electrode 4, the common electrode 17, the individual electrodes 19, the IC-connector connection electrodes 21, and the IC-IC connection electrodes 26. The resistor layer 15 includes exposed regions, which are exposed, between the common electrode 17 and the individual electrodes 19. As illustrated in FIG. 1, the exposed regions of the resistor layer 15 are arranged in a row on the bulging portion 13*b* of the heat storage layer 13. The exposed regions constitute the heating elements 9.

The plurality of heating elements 9, although illustrated in a simplified way in FIG. 1 for convenience of description, are arranged, for example, with a density of 100 dpi to 2400 dpi (dot per inch). The resistor layer 15 is made of a material having a comparatively high resistance, such as a TaN-based material, a TaSiO-based material, a TaSiNO-based material, a TiSiO-based material, TiSiCO-based material, or a NbSiO-based material. Therefore, when a voltage is applied to the heating elements 9, the heating elements 9 generate heat by Joule heating.

Figure 2:
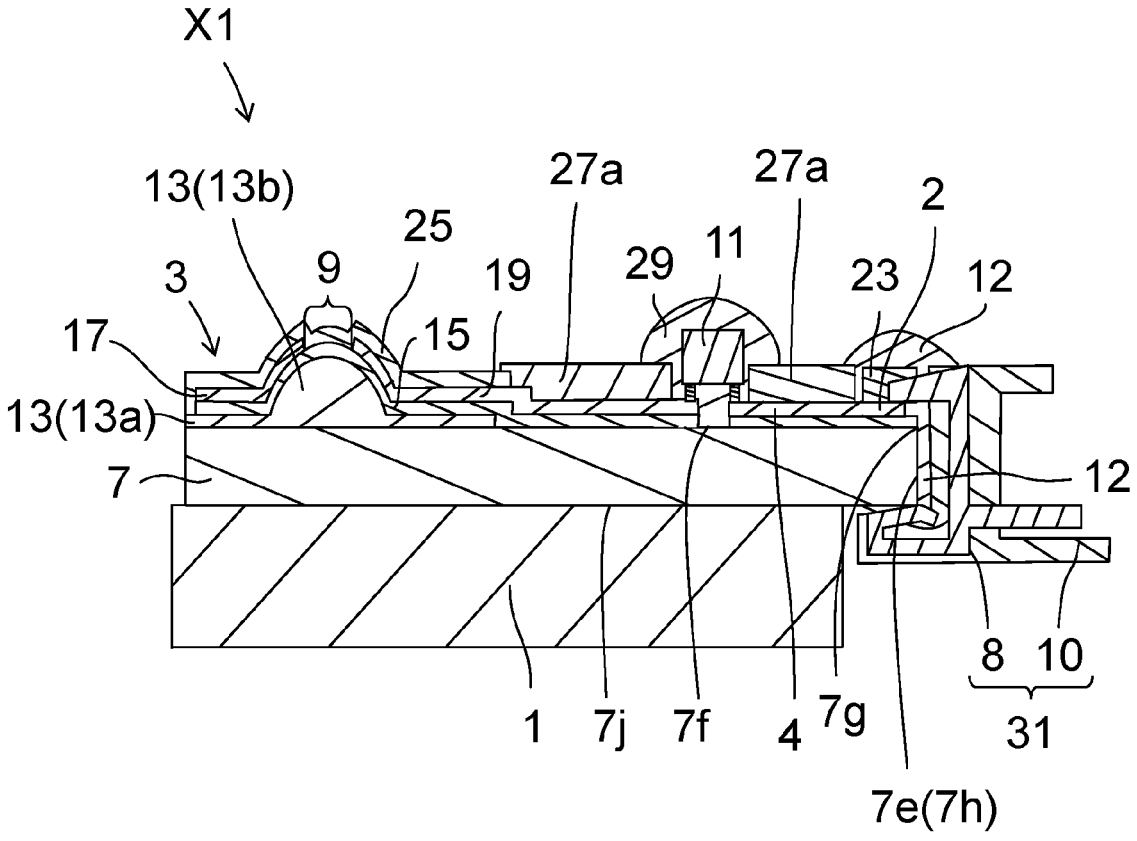
FIG. 2 is a sectional view taken along line I-I shown in FIG. 1.
Figure 3A:
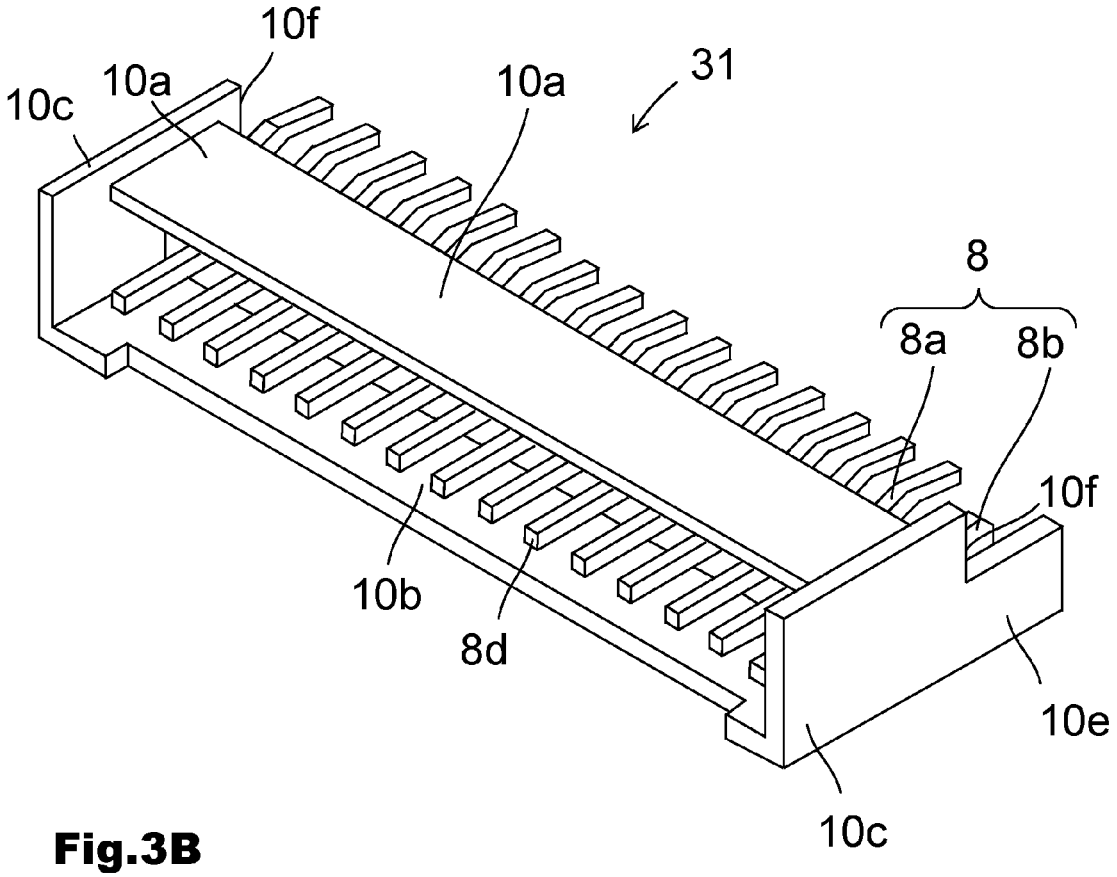
FIGS. 3A and 3B illustrate a connector of the thermal head according to the first embodiment.
Figure 3B:
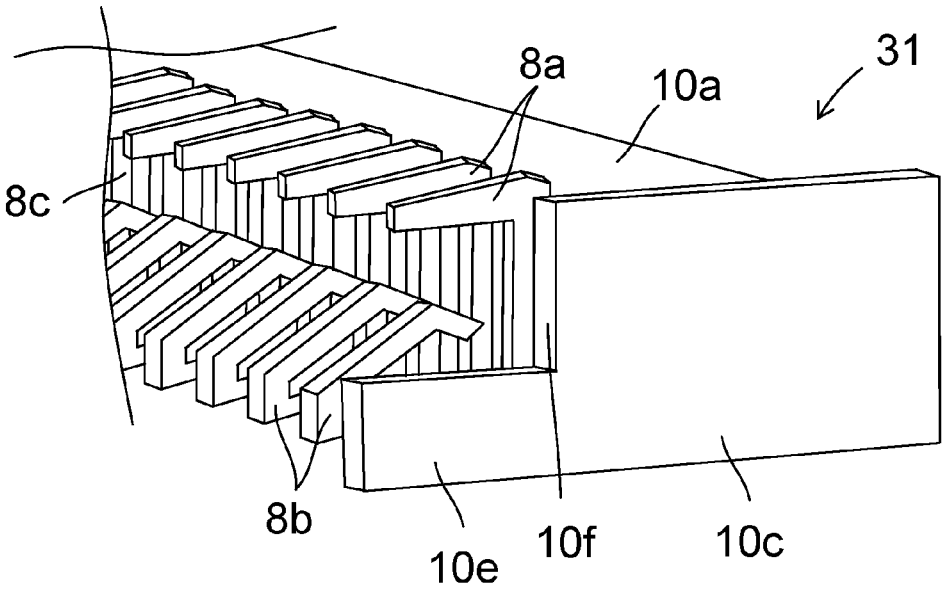
Figure 4A:
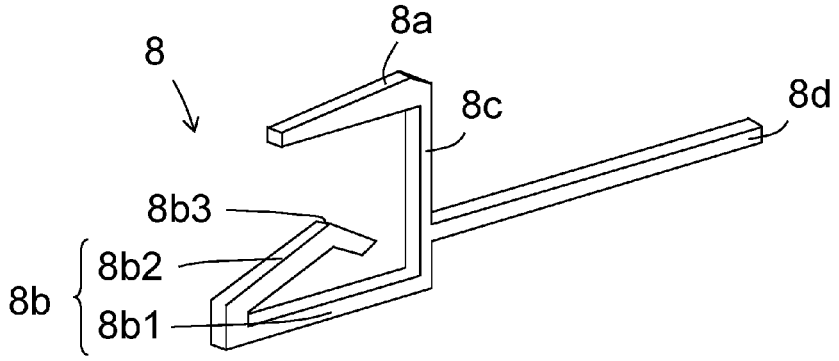
FIGS. 4A, 4B, and 4C illustrate the connector of the thermal head according to the first embodiment.
Figure 4B:
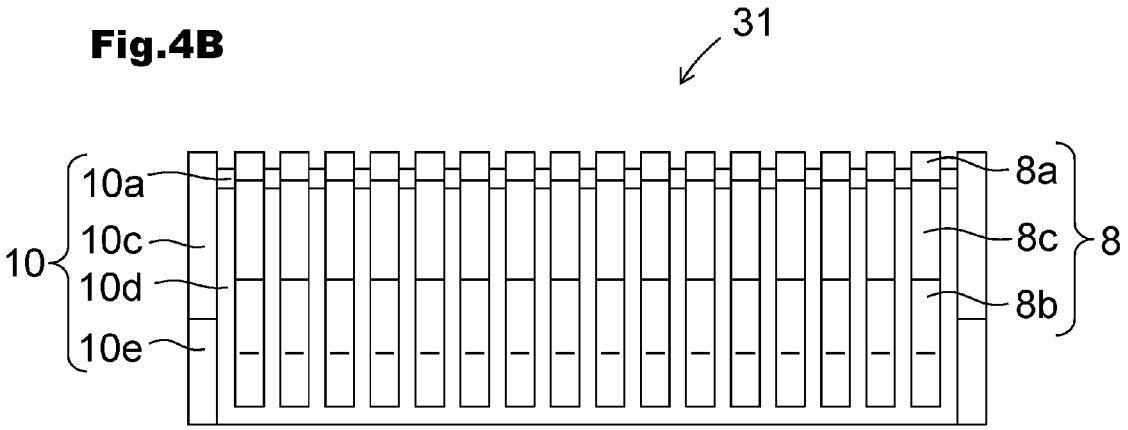
Figure 4C:
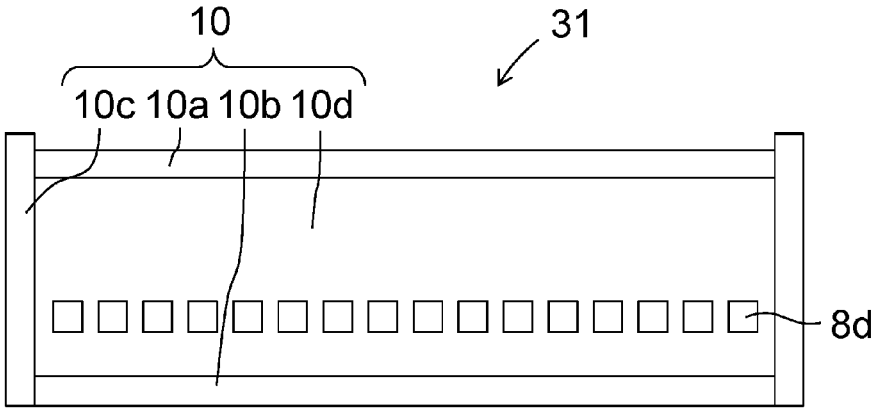

As illustrated in FIGS. 1 and 2, the connection terminals 2, the ground electrode 4, the common electrode 17, the plurality of individual electrodes 19, the IC-connector connection electrodes 21, and the IC-IC connection electrodes 26 are disposed on an upper surface of the resistor layer 15. The connection terminals 2, the ground electrode 4, the common electrode 17, the individual electrodes 19, the IC-connector connection electrodes 21, and the IC-IC connection electrodes 26 are made of an electroconductive material, such as a metal that is aluminum, gold, silver, or copper, or an alloy of these metals.

The common electrode 17 includes main wiring portions 17*a* and 17*d*, sub-wiring portions 17*b*, and lead portions 17*c*. The main wiring portion 17*a* extends along the one long side 7*a* of the substrate 7. The sub-wiring portions 17*b* extend respectively along the one short side 7*c* and the other short side 7*d* of the substrate 7. The lead portions 17*c* individually extend from the main wiring portion 17*a* toward the heating elements 9. The main wiring portion 17*d* extends along the other long side 7*b* of the substrate 7.

The common electrode 17 electrically connects the plurality of heating elements 9 to the connector 31. To reduce the resistance of the main wiring portion 17*a*, the main wiring portion 17*a* may be a thick electrode portion (not shown) that is thicker than the other portions of the common electrode 17. By doing so, the electric capacity of the main wiring portion 17*a* can be increased.

The plurality of individual electrodes 19 electrically connect the heating elements 9 to drive ICs 11. The individual electrodes 19 divide the plurality of heating elements 9 into a plurality of groups and electrically connect the heating elements 9 of each group to a corresponding one of the drive ICs 11.

The plurality of IC-connector connection electrodes 21 electrically connect the drive ICs 11 to the connector 31. The plurality of IC-connector connection electrodes 21, which are connected to the drive ICs 11, include a plurality of wires having different functions.

The ground electrode 4 is disposed so as to be surrounded by the individual electrodes 19, the IC-connector connection electrodes 21, and the main wiring portions 17*d* of the common electrode 17, and has a large area. The ground electrode 4 has a ground electric potential in the range of 0 to 1 V.

The connection terminals 2 are disposed adjacent to the other long side 7*b* of the substrate 7 so as to connect the common electrode 17, the individual electrodes 19, the IC-connector connection electrodes 21, and the ground electrode 4 to the connector 31. The connection terminals 2 correspond to the connector pins 8. When connecting the connection terminals 2 to the connector 31, the connector pins 8 and the connection terminals 2 are connected to each other in such a way that the connection terminals 2 are electrically insulated from each other. The connection terminals 2 may be connected to various electrodes or may be formed by parts of various electrodes.

The plurality of IC-IC connection electrodes 26 electrically connect the adjacent drive ICs 11. The plurality of IC-IC connection electrodes 26 correspond to the IC-connector connection electrodes 21 and transmit various signals to the adjacent drive ICs 11.

The resistor layer 15, the connection terminals 2, the common electrode 17, the individual electrodes 19, the ground electrode 4, the IC-connector connection electrodes 21, and the IC-IC connection electrodes 26 are formed by, for example, successively forming material layers of each of these on the heat storage layer 13 by using a known thin-film forming technology, such as sputtering, and then patterning the stacked body in a predetermined pattern by using a known photoetching method or the like. The connection terminals 2, the common electrode 17, the individual electrodes 19, the ground electrode 4, the IC-connector connection electrodes 21, and the IC-IC connection electrodes 26 can be simultaneously formed through the same process.

As illustrated in FIG. 1, the drive ICs 11 are disposed so as to correspond to the groups of the plurality of heating elements 9. Each of the drive ICs 11 is connected to the other end portion of each of the individual electrodes 19 and one end portion of each of the IC-connector connection electrodes 21. The drive IC 11 has a function of controlling energization of the heating elements 9. A switching member including a plurality of switching devices may be used as the drive IC 11.

Each of the drive ICs 11 is sealed with a sealing resin 29, which is made of a resin such as epoxy resin or silicone resin, in a state in which the drive IC 11 is connected to the individual electrodes 19, the IC-IC connection electrodes 26, and the IC-connector connection electrodes 21.

As illustrated in FIGS. 1 and 2, the protective layer 25, which covers the heating elements 9, a part of the common electrode 17, and parts of the individual electrodes 19, is formed on the heat storage layer 13 on the first main surface 7*f* of the substrate 7.

The protective layer 25 protects covered regions of the heating elements 9, the common electrode 17, and the individual electrodes 19 from corrosion due to adhesion of water or the like contained in air or wear due to contact with a recording medium on which printing is performed. The protective layer 25 may be made of SiN, SiO2, SiON, SiC, diamond-like carbon, or the like. The protective layer 25 may have only one layer or may have a stack of layers. The protective layer 25 can be formed by using a thin-film forming technology, such as sputtering, or a thick film forming technology, such as screen printing.

As illustrated in FIGS. 1 and 2, a first covering layer 27*a*, which partially covers the common electrode 17, the individual electrodes 19, the IC-IC connection electrodes 26, and the IC-connector connection electrodes 21, is disposed on the first main surface 7*f* of the substrate 7. The first covering layer 27*a* protects the covered regions of the common electrode 17, the individual electrodes 19, the IC-IC connection electrodes 26, and the IC-connector connection electrodes 21 from oxidation due to contact with air or from corrosion due to adhesion of water or the like contained in air.

The first covering layer 27*a* has openings 27*a*1 for exposing the individual electrodes 19, the IC-IC connection electrodes 26, and the IC-connector connection electrodes 21, which are connected to the drive ICs 11. These wires, which are exposed from the opening 27*a*1, are connected to the drive ICs 11. The first covering layer 27*a* has an opening 27*a*2, for exposing the connection terminals 2, near the other long side 7*b* of the substrate 7. The connection terminals 2, which are exposed from the opening 27*a*2, are electrically connected to the connector pins 8.

A second covering layer 27*b* extends from the first covering layer 27*a* onto the end surface 7*e* of the substrate 7. Therefore, the second covering layer 27*b* is continuous with the first covering layer 27*a*, and the first covering layer 27*a* and the second covering layer 27*b* cover the first corner 7*g*. The second covering layer 27*b* is disposed so that a part of the end surface 7*e* is exposed as an exposed portion 7*h*. Alternatively, the second covering layer 27*b* need not be disposed so that a part of the end surface 7*e* is exposed. That is, the second covering layer 27*b* may be disposed over the entirety of the end surface 7*e*.

The first covering layer 27*a* and the second covering layer 27*b* may be formed, for example, from a resin material, such as epoxy resin or polyimide resin, by using a thick film forming technology, such as screen printing. The first covering layer 27*a* and the second covering layer 27*b* may be made of different materials. In the present embodiment, an epoxy thermosetting resin is used as the first covering layer 27*a* and the second covering layer 27*b*.

The first covering layer 27*a* and the second covering layer 27*b* can be formed by screen printing. For example, the first covering layer 27*a* and the second covering layer 27*b* can be formed by applying and curing the first covering layer 27*a* on the first main surface 7*f* and then applying and curing the second covering layer 27*b* on the end surface 7*e* so as to become continuous with the first covering layer 27*a*. Alternatively, the first covering layer 27*a* and the second covering layer 27*b* may be simultaneously formed by applying a resin also to the end surface 7*e* when applying the resin to the first main surface 7*f*.

The connector 31 and the head base body 3 are fixed to each other via the connector pins 8, a solder 23, and the covering member 12. As illustrated in FIGS. 1 and 2, the connector pins 8 are disposed on the connection terminals 2 of the ground electrode 4 and the connection terminals 2 of the IC-connector connection electrodes 21. As illustrated in FIG. 2, the connection terminals 2 and the connector pins 8 are connected to each other via the solder 23. Without using the solder 23, the connection terminals 2 and the connector pins 8 may be electrically connected directly.

The solder 23 is, for example, a Pb-based solder. The connector pins 8 are covered by the solder 23 and thereby electrically connected to the connection terminals 2. A plating layer (not shown), which is made of Ni, Au, or Pd, may be formed between the solder 23 and the connection terminals 2.

As illustrated in FIGS. 3 to 6, the connector 31 includes the plurality of connector pins 8 and the housing 10, which contains the plurality of connector pins 8. The connector 31 is joined to the substrate 7 as the connector pins 8 hold the substrate 7 therebetween.

Each of the connector pins 8 includes a first connector pin 8*a*, a second connector pin 8*b*, a link portion 8*c*, and a lead portion 8*d*. In each of the connector pins 8, the first connector pin 8*a* and the second connector pin 8*b* are connected to each other through the link portion 8*c*, and the lead portion 8*d* extends from the link portion 8*c* in a direction away from the substrate 7. The plurality of connector pins 8 are arranged in the main scanning direction with spaces therebetween. The connector pins 8 are separated from each other, and adjacent connector pins 8, through which different signals are transmitted, are electrically insulated from each other.

The first connector pins 8*a* are disposed on the connection terminals 2 (see FIG. 1). The second connector pins 8*b* are disposed below the substrate 7 of the head base body 3. The first connector pins 8*a* and the second connector pins 8*b* hold the substrate 3 therebetween. The link portions 8*c* are connected to the first connector pins 8*a* and the second connector pins 8*b* and extend in the thickness direction of the substrate 7. The lead portions 8*d* extend in a direction away from the head base body 3 and is joined to the housing 10. The connector 31 and the head base body 3 are electrically and mechanically joined to each other as the head base body 3 is inserted into a space between the first connector pins 8*a* and the second connector pins 8*b*.

Each of the second connector pins 8*b* includes a first portion 8*b*1 and a second portion 8*b*2. The first portion 8*b*1 extends in a direction away from the link portion 8*c*. The second portion 8*b*2 is continuous with the first portion 8*b*1 and extends toward a link portion 9*c* at an angle with respect to the first portion 8*b*1. The second portion 8*b*2 includes a contact portion 8*b*3, and the contact portion 8*b*3 is in contact with the substrate 7.

Therefore, the second connector pin 8*b* includes the first portion 8*b*1 and the second portion 8*b*2, which are continuously formed, and has a curved shape at a connection region between the first portion 8*b*1 and the second portion 8*b*2. Thus, when inserting the substrate 7, the second connector pin 8*b* and the first connector pin 8*a* hold the substrate 7 therebetween while the second connector pin 8*b* elastically deforms. As a result, the substrate 7 can be inserted into the connector 31 in a state in which the substrate 7 and the first connector pin 8 do not contact each other, so that the probability of breakage of the connection terminal 2 and the first corner 7*g* of the substrate 7 can be reduced.

The link portion 8*c* links the first connector pin 8*a* and the second connector pin 8*b* and extends in the thickness direction of the substrate 7. That is, the link portion 8*c* is a portion of the second connector pin 8*b* that extends in the thickness direction. The lead portion 8*d* is connected to the link portion 8*c*. By connecting a cable (not shown) to the lead portion 8*d* from the outside, a voltage is supplied to the thermal head X1.

The connector pin 8, which need to be electroconductive, may be made of a metal or an alloy. Preferably, the first connector pin 8*a*, the second connector pin 8*b*, the link portion 8*c*, and the lead portion 8*d* of each of the connector pin 8 are integrally formed. For example, the connector pin 8 can be made by punching a thin metal plate.

The housing 10 has a box shape having an opening facing away from the substrate 7 and has a function of containing the connector pins 8 in state in which the connector pins 8 are electrically insulated from each other. A socket, to which cables are connected from the outside, is inserted into the opening of the housing 10. By connecting or disconnecting the cables or the like, which are disposed outside, electricity is supplied to the head base body 3.

The housing 10 includes an upper wall 10*a*, a lower wall 10*b*, side walls 10*c*, a front wall 10*d*, and support portions 10*e*. The opening of the housing 10 is defined by the upper wall 10*a*, the lower wall 10*b*, the side walls 10*c*, and the front wall 10*d*. The opening is formed in the housing 10 near the lead portion 8*d* of the connector pins 8. The side walls 10*c* have positioning portions 10*f* near the end surface 7*e*. The positioning portions 10*f* have a function of positioning the head base body 3 that is inserted. The second covering layer 27*b* of the head base body 3 is abutted against the positioning portions 10*f*.

The support portions 10*e* extend from the side walls 10*c* toward positions below the substrate 7. The support portions 10*e* and the substrate 7 are disposed so as to be separated from each other. The support portions 10*e* extend further than the connector pin 8 from the side walls 10*c* toward positions below the substrate 7.

The front wall 10*d* has through-holes (not shown) through which the lead portions 8*d* extend. In a front view of the housing 10, grooves (not shown), which pass through the through-holes, are formed in the thickness direction of the housing 10. The link portions 9*c* are contained in the grooves, and the link portions 8*c* are embedded in the housing 10.

The covering member 12 is disposed so that the connection terminals 2 and the first connector pins 8*a* are not exposed to the outside. The covering member 12 seals the connection terminals 2 and the first connector pins 8*a*. The covering member 12 joins the substrate 7 and the connector 31 and reinforces the electrical and mechanical connection between the connection terminals 2 and the first connector pins 8*a*.

The covering member 12 may be made of, for example, an epoxy thermosetting resin, a thermosoftening resin, a UV curable resin, or a visible-light curable resin. Preferably, the covering member 12 is made of a material having higher hardness than the first covering layer 27*a* and the second covering layer 27*b*, because the covering member 12 is used to join the substrate 7 and the connector 31. In the present embodiment, an epoxy thermosetting resin is used as the covering member 12.

Figure 5A:
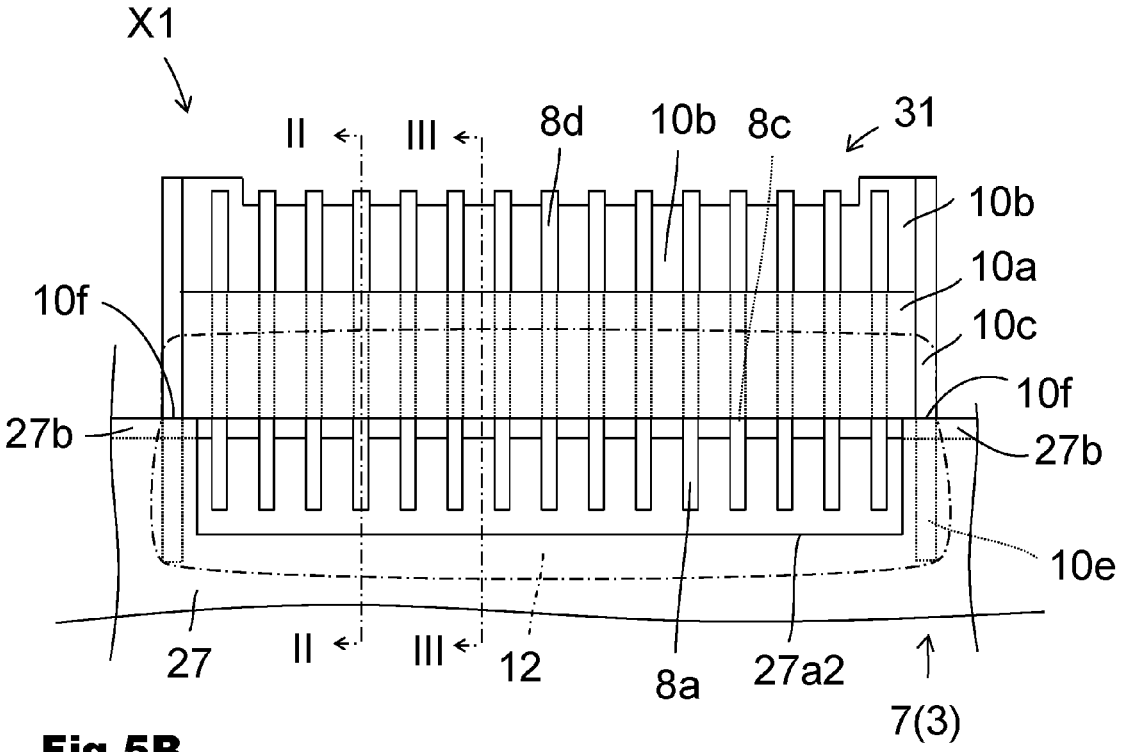
FIGS. 5A and 5B show enlarged views of a region near the connector of the thermal head according to the first embodiment.
Figure 5B:
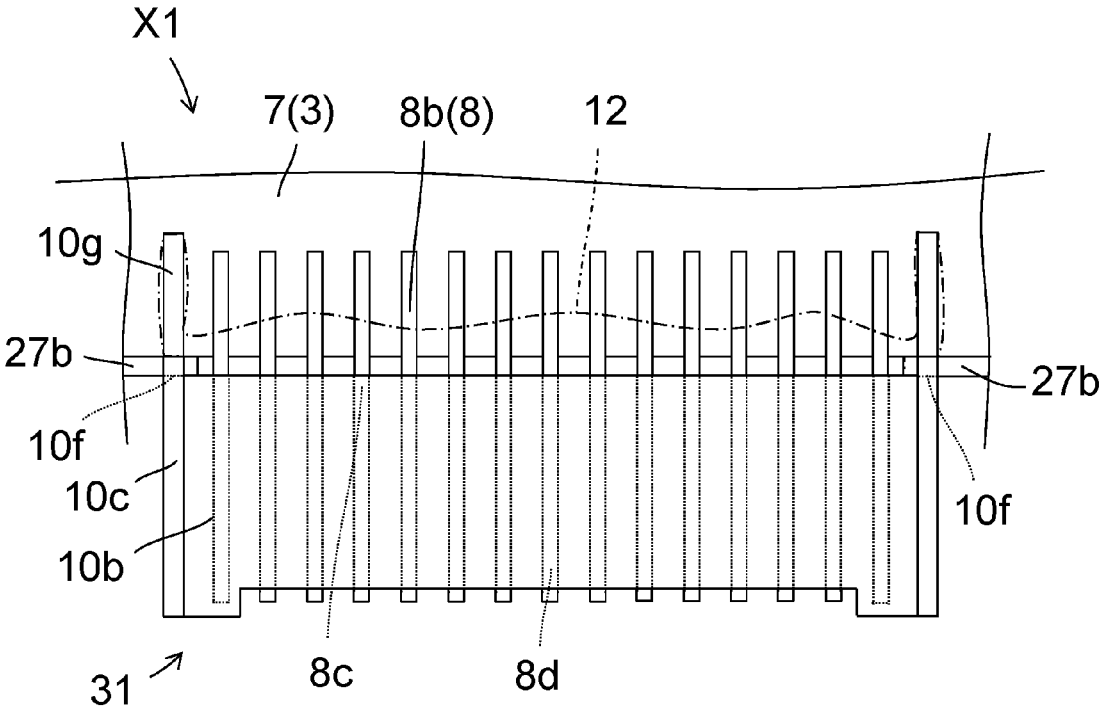
Figure 6A:
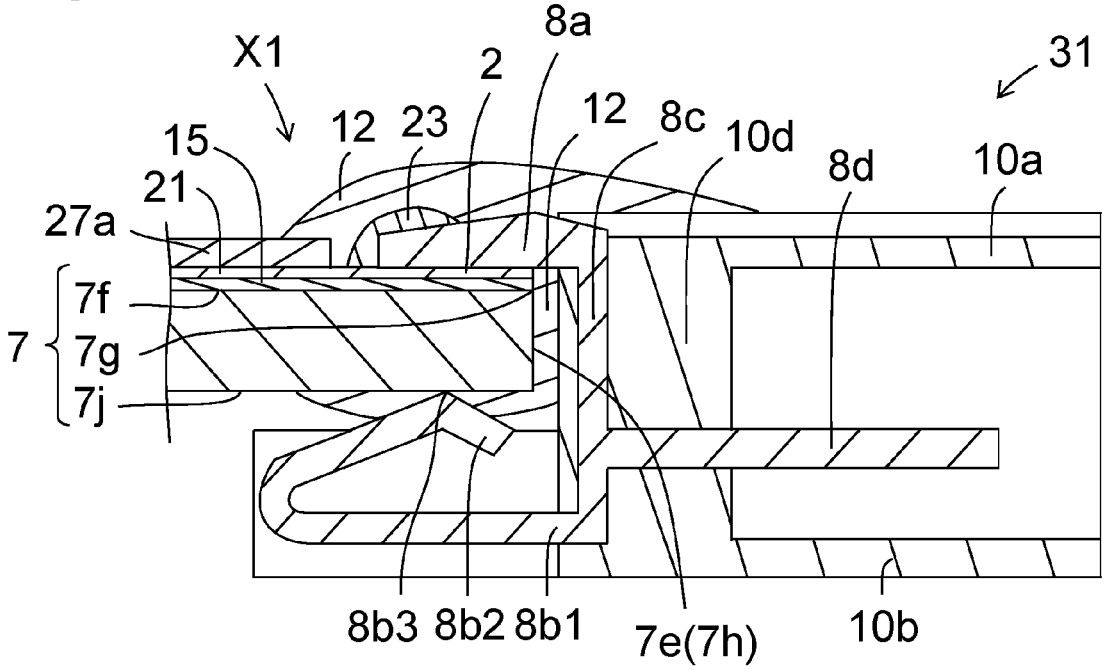
FIG. 6A is a sectional view taken along line II-II shown in FIG. 5A.
Figure 6B:
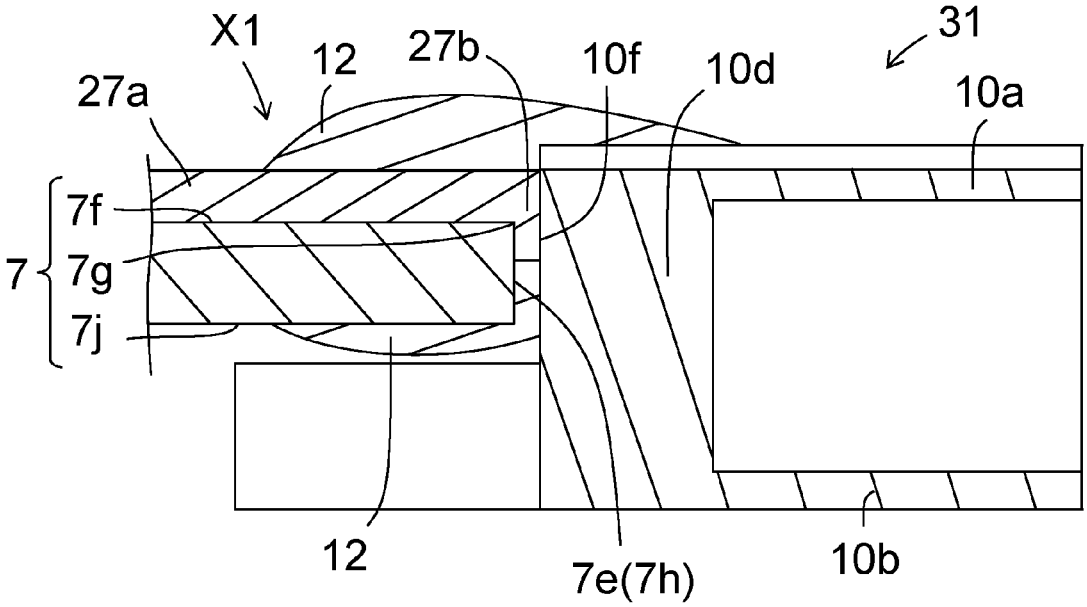
FIG. 6B is a sectional view taken along line shown in FIG. 5A.

As illustrated in FIGS. 5 and 6, the covering member 12 is disposed on the first connector pins 8*a* and on the second connector pins 8*b*. A part of the covering member 12 that is disposed on the first connector pins 8*a* is also disposed on the upper wall 10*a* and the side walls 10*c* of the housing 10 and on the first covering layer 27*a*.

A part of the covering member 12 that is disposed on the second connector pin 8*b* is also disposed on the support portions 10*e* and the side walls 10*c*. The part of the covering member 12 disposed on the second connector pin 8*b* is disposed at both end portions and a central portion in the main scanning direction so as to protrude from the housing 10. Thus, the housing 10 is strongly connected to the substrate 7 against an external force in the main scanning direction.

The covering member 12 is disposed so as to completely cover the first connector pins 8*a*. The second connector pins 8*b* are disposed so as to cover the contact portions 8*b*3, and parts of the first portions 8*b*1 and the second portions 8*b*2 of the second connector pins 8*b* are exposed.

The covering member 12 is disposed also between the front wall 10*d* of the housing 10 and the end surface 7*e* of the substrate 7. The second covering layer 27*b* is disposed only a part of the end surface 7*e* near a main surface 7*a*. That is, a part of the end surface 7*e* includes the exposed portion 7*h*, which is exposed from the second covering layer 27*b*.

The substrate 7 is inserted into a space between the first connector pins 8*a* and the second connector pins 8*b* of the connector 31, and the side surface 7*e* of the substrate 7 is abutted against the positioning portions 10*f* of the side walls 10*c* of the housing 10. Therefore, when the side surface 7*e* of the substrate 7 contacts the positioning portions 10*f* of the housing 10, breakage may occur.

To prevent this, the thermal head X1 includes the second covering layer 27*b*, which extends from the first covering layer 27*a* onto the end surface 7*e* of the substrate 7, and the positioning portions 10*f* of the housing 10 are in contact with the second covering layer 27*b*. Therefore, when the substrate 7 is inserted into the housing 10, the substrate 7 contacts the second covering layer 27*b*. As a result, the second covering layer 27*b* absorbs impact when the substrate is abutted against the housing 10, and the probability of breakage of the side surface 7*e* of the substrate 7 can be reduced.

Because the substrate 7 is abutted against the housing 10 so that the second covering layer 27*b* is in contact with the positioning portions 10*f* of the housing 10, the head base body 3 is not abutted against the link portions 8*c* of the connector pins 8. Therefore, the probability of the connector pins 8 becoming, for example, bent and broken can be reduced.

The housing 10 has a box shape having an opening facing away from the substrate 7. The housing includes the front wall 10*d*, which is disposed adjacent to the substrate 7, and the side walls 10*c*, which are located on both sides of the front wall 10*d* in the main scanning direction, and the side walls 10*c* are in contact with the second covering layer 27*b*.

Therefore, the connector 31 is abutted against the substrate 7 at both end portions in the main scanning direction. As a result, in plan view, the probability of the connector 31 becoming inclined relative to the substrate 7 can be reduced, and the reliability of electrical connection between the head base body 3 and the connector 31 can be increased.

The substrate 7 has the first corner 7*g*, which is defined by the first main surface 7*f* and the end surface 7*e*. The first corner 7*g* is covered by the first covering layer 27*a* and the second covering layer 27*b*. That is, the first corner 7*g* is covered by the first covering layer 27*a* and the second covering layer 27*b* so as not to be exposed. Thus, the first corner 7*g*, which tends to break easily, can be reinforced by the first covering layer 27*a* and the second covering layer 27*b*, and the probability of the connector 31 contacting the first corner 7*g* can be reduced. As a result, the probability of chipping of the first corner 7*g* can be reduced.

If the second covering layer 27*b* were disposed over the entire area of the end surface 7*e* of the substrate 7, a gap, into which the covering member 12 can flow, would not be formed between the second covering layer 27*b* and the housing 10.

To prevent this, the end surface 7*e* of the substrate 7 has the exposed portion 7*h*, which is exposed from the second covering layer 27*b*; and the covering member 12 is disposed between the connector 31 and the exposed portion 7*h* and joins the connector 31 and the exposed portion 7*h*. Thus, the covering member 12, which is disposed between the connector 31 and the exposed portion 7*h*, can join not the connector 31 and the second covering layer 27*b* but the connector 31 and the substrate 7. Therefore, the joint strength of the connector 31 and the substrate 7 can be increased.

Because the housing 10 is in contact with the second covering layer 27*b* on the end surface 7*e*, when fitting the connector 31 onto the substrate 7, the connector 31 can be fitted onto the substrate 7 easily by only abutting the housing 10 against the second covering layer 27*b*. As a result, the connector 31 and the substrate 7 can be connected to each other through a simple process.

The surface roughness of the exposed portion 7*e* is greater than the surface roughness of the second covering layer 27*b*. Thus, when the covering member 12 is applied to the exposed portion 7*h*, an anchoring effect is produced and the covering member 12 flows into the exposed portion 7*h*. As a result, the contact area between the covering member 12 and the exposed portion 7*h* is increased, and the joint strength of the connector 31 and the substrate 7 can be increased.

That is, the exposed portion 7*h* has recesses and protrusions on the surface thereof, and the covering member 12 flows into the recesses of the exposed portion 7*h*. Therefore, the covering member 12 contacts the surfaces of the recesses of the exposed portion 7*h*, and the contact area between the covering member 12 and the exposed portion 7*h* is increased. As a result, the joint strength between the connector 31 and the substrate 7 can be increased.

Because the surface roughness of the second covering layer 27*b* is smaller than the surface roughness of the exposed portion 7*e*, the probability of breakage of the housing 10 when fitting the connector 31 onto the substrate 7 can be further reduced.

The arithmetic-average surface roughness (Ra) of the exposed portion 7*h* may be, for example, in the range of 7.5 to 8.5. The arithmetic-average surface roughness (Ra) of the second covering layer 27*b* may be, for example, in the range of 5.5 to 6.5. The surface roughness can be measured by using a contact or non-contact profilometer.

End portions of the second covering layer 27*b* are covered by the covering member 12. Thus, when the second covering layer 27*b* contacts the housing 12 and the end portions of the second covering layer 27*b* are peeled off, the covering member 12 can hold the end portions of the second covering layer 27*b*. As a result, the probability of peeling-off of the second covering layer 27*b* can be reduced.

In the thermal head X2, the thickness of the second covering layer 27*b* disposed on the end surface 7*e* is smaller than the thickness of the first covering layer 27*a* disposed on the first main surface 7*f*. Therefore, the joint strength between the connector 31 and the substrate 7 can be increased while reliably sealing various electrodes with the first covering layer 27*a* disposed on the first main surface 7*f*.

That is, because the thickness of the second covering layer 27*b* disposed on the end surface 7*e* is smaller than the thickness of the first covering layer 27*a* disposed on the first main surface 7*f*, the distance between the connector 31 and the exposed portion 7*h* can be reduced, and the covering member 12 can be disposed over the entirety of the exposed portion 7*h* due to capillary action. Thus, the joint strength between the connector 31 and the substrate 7 can be increased.

Moreover, because the thickness of the second covering layer 27*b* disposed on the end surface 7*e* is smaller than the thickness of the first covering layer 27*a* disposed on the first main surface 7*f*, increase in the distance between the end surface 7*e* and the connector 31 can be suppressed, and positioning of the connector 31 can be easily performed.

The thickness of the first covering layer 27*a* may be in the range of 10 to 30 μm. The thickness of the second covering layer 27*b* may be in the range of 5 to 20 μm. When the thickness of the second covering layer 27*b* is in the range of 5 to 15 μm, capillary action of the covering member 12 described below can function effectively. The length of the second covering layer 27*b* on the end surface 7*e* may be in the range of 50 to 300 μm.

The thickness of each of the first covering layer 27*a* and the second covering layer 27*b* is an average thickness. For example, the thicknesses of three portions of the first covering layer 27*a* directly below the substrate 7 may be measured, and the average of the thicknesses may be used as the thickness of the first covering layer 27*a*. The thickness of the second covering layer 27*b* may be measured in the same way.

In the example of the thermal head X1 described above, the thickness of the second covering layer 27*b* disposed on the end surface 7*e* is smaller than the thickness of the first covering layer 27*a* disposed on the first main surface 7*f*. However, this is not a limitation. The thickness of the first covering layer 27*a* may be equal to the thickness of the second covering layer 27*b*, or the thickness of the second covering layer 27*b* may be greater than the thickness of the first covering layer 27*a*.

Hereinafter, how the components of the thermal head X1 are joined will be described.

First, the substrate 7, on which the components of the head base body 3 have been formed, and the connector 31 are joined to each other. The substrate 7 is inserted into a space between the first connector pins 8*a* and the second connector pins 8*b* of the connector 31. At this time, the substrate 7 is inserted while pressing the second connector pins 8*b* so that a predetermined space is formed between the first connector pins 8*a* and the substrate 7, and the second covering layer 27*b* is abutted against the positioning portions 10*f*. Thus, the probability of breakage of the side surface 7*e* of the substrate 7 can be reduced.

Then, pressing of the second connector pins 8*b* is stopped, so that the second connector pins 8*b* elastically deforms and thereby the first connector pins 8*a* and the connection terminals 2 contact each other. Next, the solder 23 is applied to the first connector pins 8*a* by printing and is caused to reflow. Thus, the connector 31 and the substrate 7 are electrically and mechanically joined to each other.

Next, the covering member 12 is applied and dried by screen printing or by using a dispenser so as to cover the first connector pins 8*a* and the connection terminals 2. After the covering member 12 on the first connector pins 8*a* has been dried, the covering member 12 is applied by screen printing or by using a dispenser so that parts of the second connector pins 8*b* are exposed. When the covering member 12 is applied from the second connector pin 8*b* side, a part of the covering member 12 flows into a space between the connector 31 and the exposed portion 7*h*. Thus, the covering member 12 is disposed between the connector 31 and the exposed portion 7*h*. Subsequently, the covering member 12 is dried.

Next, the head base body 3, to which the covering member 12 is applied, is placed on the heat sink 1 on which double-sided tape or the like is disposed. The head base body 3 is placed in an oven and the covering member 12 is cured. The substrate 7 may be joined to the heat sink 1 after curing the covering member 12, or the covering member 12 may be applied and cured after joining the substrate 7 to the heat sink 1.

Next, a thermal printer Z1 will be described with reference to FIG. 7.

Figure 7:
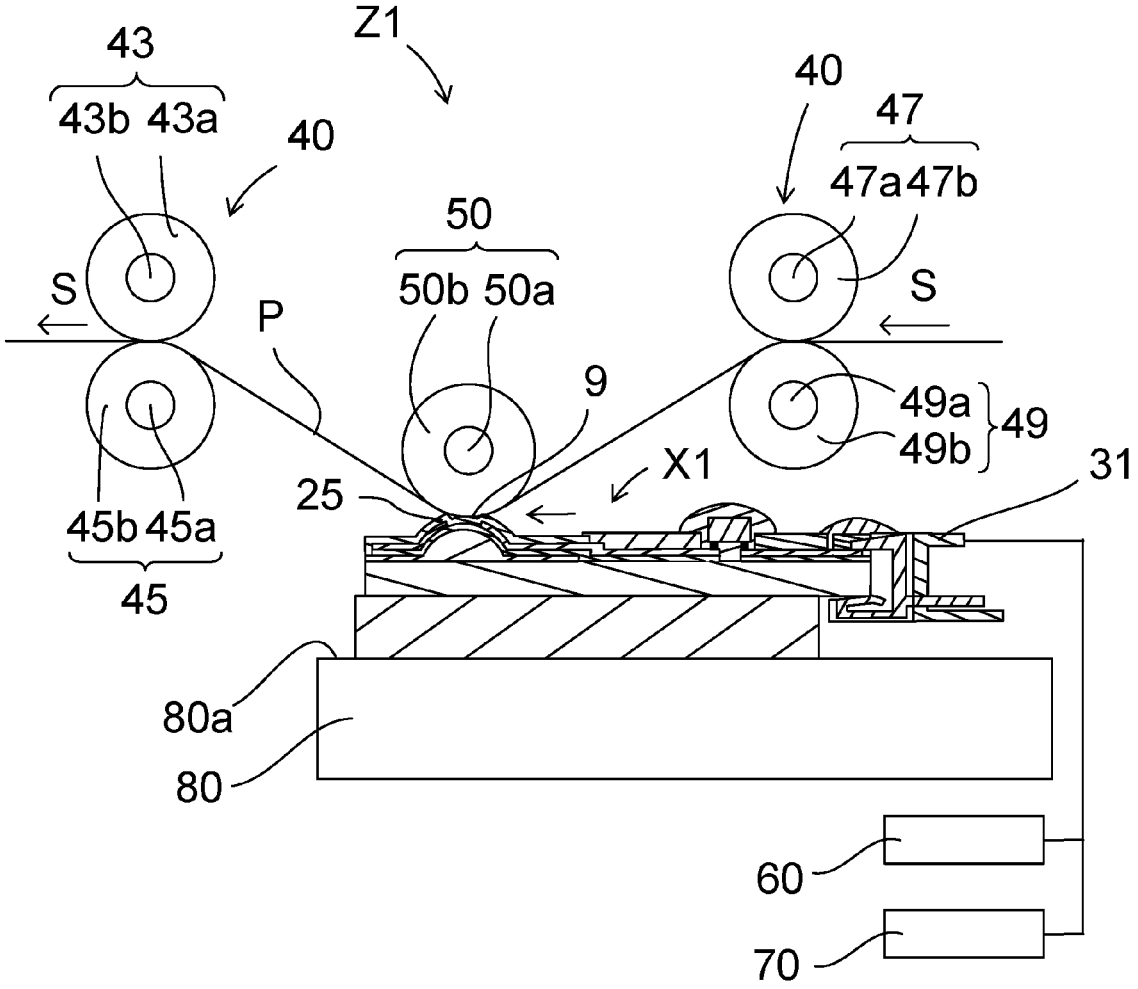
FIG. 7 is a schematic view of a thermal printer according to the first embodiment.

As illustrated in FIG. 7, the thermal printer Z1 according to the present embodiment includes the thermal head X1, a transport mechanism 40, a platen roller 50, a power supply 60, and a control device 70. The thermal head X1 is attached to an attachment surface 80*a* of an attachment member 80, which is disposed on a housing (not shown) of the thermal printer Z1. The thermal head X1 is attached to the attachment member 80 so as to extend in the main scanning direction, which is a direction perpendicular to the transport direction S of the recording medium P described below.

The transport mechanism 40 includes a drive unit (not shown) and transport rollers 43, 45, 47, and 49. The transport mechanism 40 transports a recording medium P, which is thermal paper, printing paper to which ink is transferred, or the like, in the direction of arrow S in FIG. 7 to transport the recording medium P onto the protective layer 25, which is located on the plurality of heating elements 9 of the thermal head X1. The drive unit has a function of driving the transport rollers 43, 45, 47, and 49. For example, a motor may be used as the drive unit. For example, the transport rollers 43, 45, 47, and 49 are made by covering cylindrical shafts 43*a*, 45*a*, 47*a*, and 49*a*, which are made of a metal such as a stainless steel, with elastic members 43*b*, 45*b*, 47*b*, and 49*b*, which are made of butadiene rubber or the like. Although not shown in the figure, if the recording medium P is printing paper to which ink is transferred or the like, an ink film is transported together with the recording medium P to a space between the recording medium P and the heating elements 9 of the thermal head X1. The platen roller 50 has a function of pressing the recording medium P against the protective film 25, which is located on the heating elements 9 of the thermal head X1. The platen roller 50 is disposed so as to extend in a direction perpendicular to the transport direction S of the recording medium P. Both end portions of the platen roller 50 are supported and fixed so that the platen roller 50 can rotate while pressing the recording medium P against the heating elements 9. For example, the platen roller 50 can be made by covering a cylindrical shaft 50*a*, which is made of a metal such as a stainless steel, with an elastic member 50*b*, which is made of butadiene rubber or the like.

The power supply 60 has a function of supplying an electric current for causing the heating elements 9 of the thermal head X1 to generate heat as described above and supplying an electric current for driving the drive ICs 11. The control device 70 has a function of supplying control signals, for controlling operations of the drive ICs 11, to the drive ICs 11 to selectively cause the heating elements 9 of the thermal head X1 to generate heat.

As illustrated in FIG. 7, the thermal printer Z1 performs predetermined printing on the recording medium P by selectively causing the heating elements 9 to generate heat by using the power supply 60 and the control device 70 while transporting the recording medium P onto the heating elements 9 by using the transport mechanism 40 and pressing the recording medium P against the heating elements 9 of the thermal head X1 by using the platen roller 50. If the recording medium P is printing paper or the like, printing on the recording medium P is performed by thermally transferring ink of an ink film (not shown), which is transported together with the recording medium P, to the recording medium P.

Second Embodiment

Figure 8:
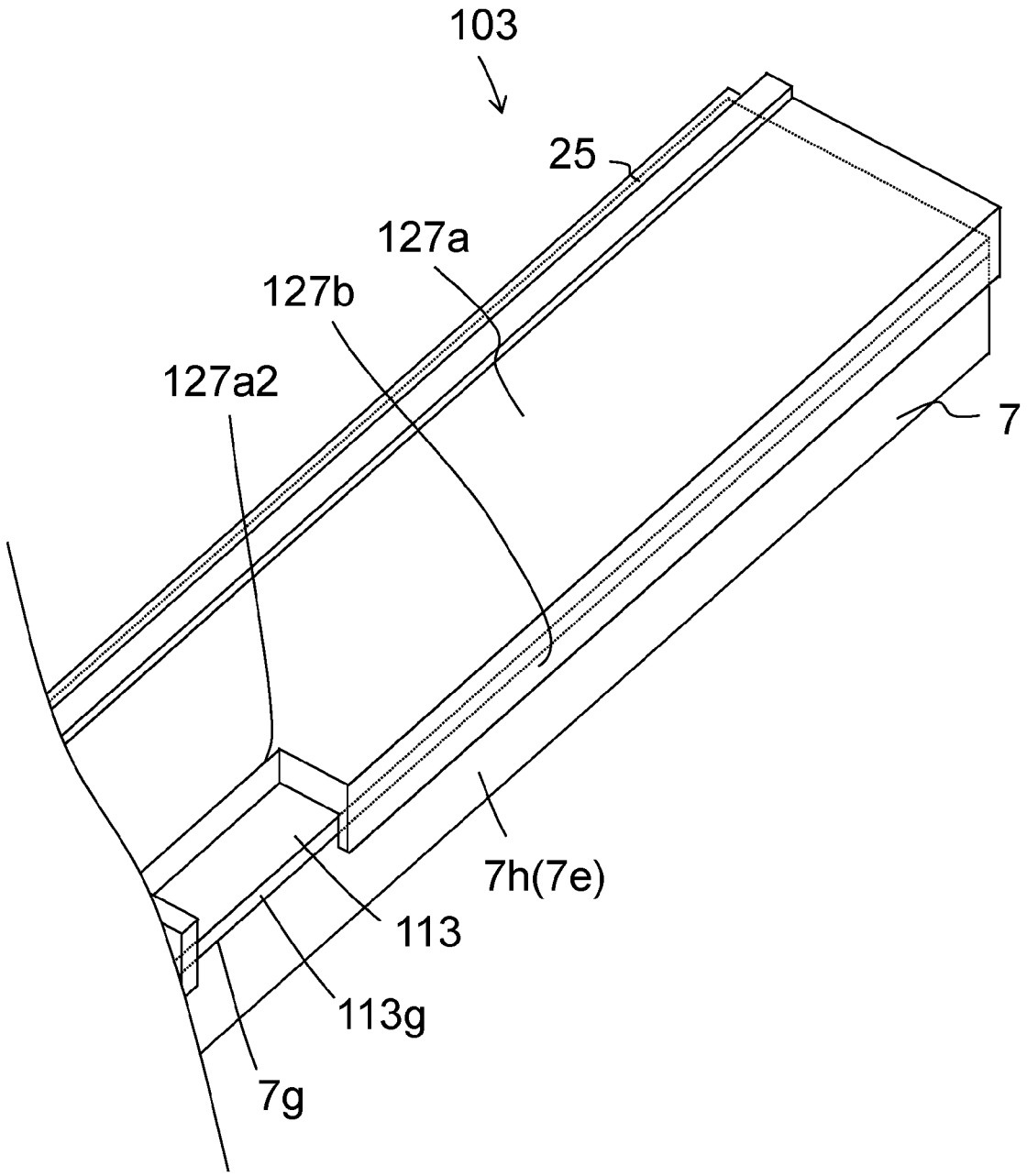
FIG. 8 is a schematic partial perspective view of a head base body of a thermal head according to a second embodiment.
Figure 9A:
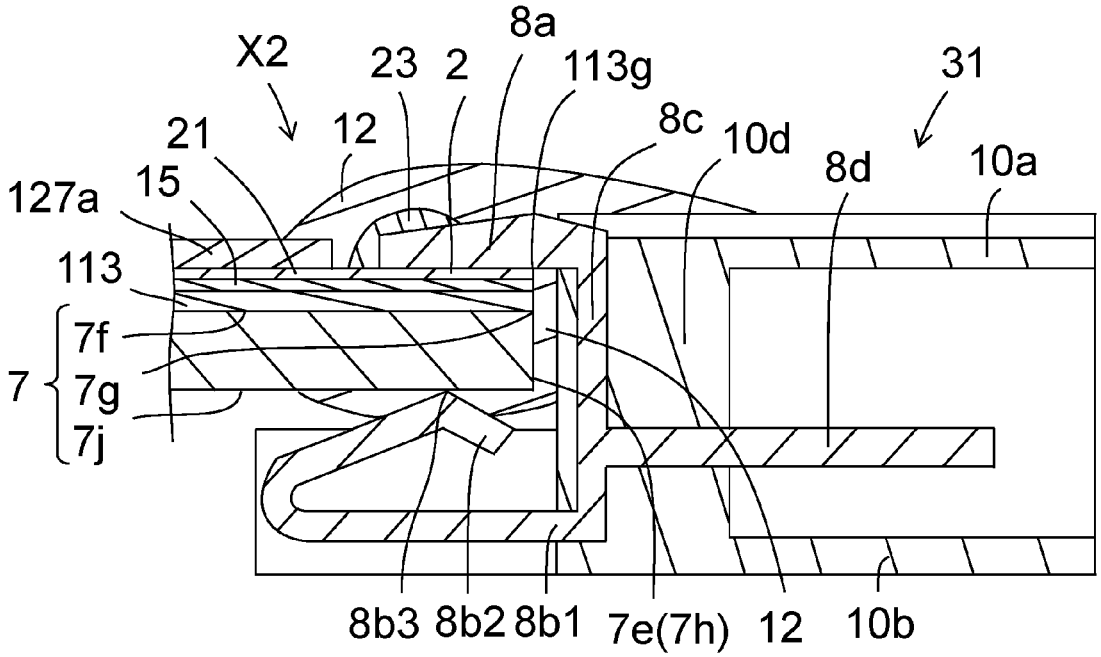
FIGS. 9A and 9B illustrate the thermal head according to the second embodiment.
Figure 9B:
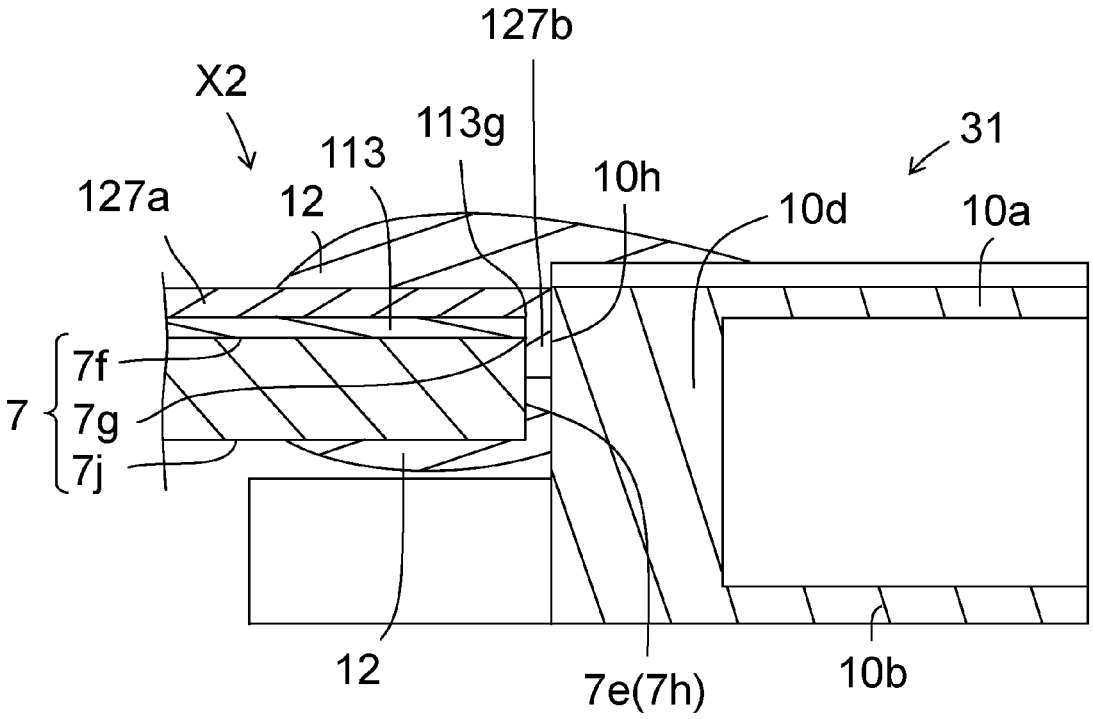

Referring to FIGS. 8 and 9, a thermal head X2 will be described. The thermal head X2 differs from the thermal head X1 in the structure of a heat storage layer 113.

Hereinafter, the same members will be denoted by the same numerals. In FIG. 8, the drive ICs 11 and the openings 27*a*1 (see FIG. 1) are omitted.

In the thermal head X2, the heat storage layer 113 is disposed on the first main surface 7*f* of the substrate 7. The heat storage layer 113 is disposed over the entirety of the first main surface 7*f*. The heat storage layer 113 includes a second corner 113*g* on the first corner 7*g*. Preferably, the thickness of the heat storage layer 113 is in the range of 20 to 50 μm. In this case, deterioration of thermal response characteristic can be suppressed while maintaining heat storage capacity.

If the second corner 113*g* of the heat storage layer 113 contacts the housing when inserting the substrate 7 into the connector 31, breakage of the second corner 113*g* may occur. In particular, when the heat storage layer 113 is made of glass, if chipping of the second corner 113*g* occurs, a crack may develop and the heat storage layer 113 may lose heat storage function.

To prevent this, a first covering layer 127*a* and a second covering layer 127*b* are disposed so as to cover the second corner 113*g*, so that the second corner 113*g* is covered by the first covering layer 127*a* and the second covering layer 127*b*. As a result, the second corner 113*g* does not directly contact the positioning portion 10*f* of the housing 10, and the probability of the connector 31 contacting the second corner 113*g* can be reduced. As a result, the probability of breakage of the second corner 113*g* can be reduced.

Because the length of the second covering layer 127*b* in the thickness direction of the substrate 7 is greater than the thickness of the heat storage layer 113, the entirety of the end surface of the heat storage layer 113 is covered by the second covering layer 127*b*. Therefore, the heat storage layer 113 is not likely to be exposed, and the probability of the heat storage layer 113 contacting the connector 31 can be reduced. Therefore, the probability of occurrence of a crack in the heat storage layer 113 can be reduced.

Because the end surface of the heat storage layer 113 (not shown) is covered by the second covering layer 127*b*, heat dissipation from the end surface of the heat storage layer 113 can be suppressed. Thus, the heat storage capacity of the heat storage layer 113 can be maintained, and the thermal response characteristic of the thermal head X2 can be improved.

The length of the second covering layer 127*b*, which is located on the end surface 7*e*, need not be greater than the thickness of the heat storage layer 113. Also in this case, the second corner 113*g* is covered by the first covering layer 127*a* and the second covering layer 127*b*, so that the probability of breakage of the second corner 113*g* can be reduced.

Third Embodiment

Figure 10:
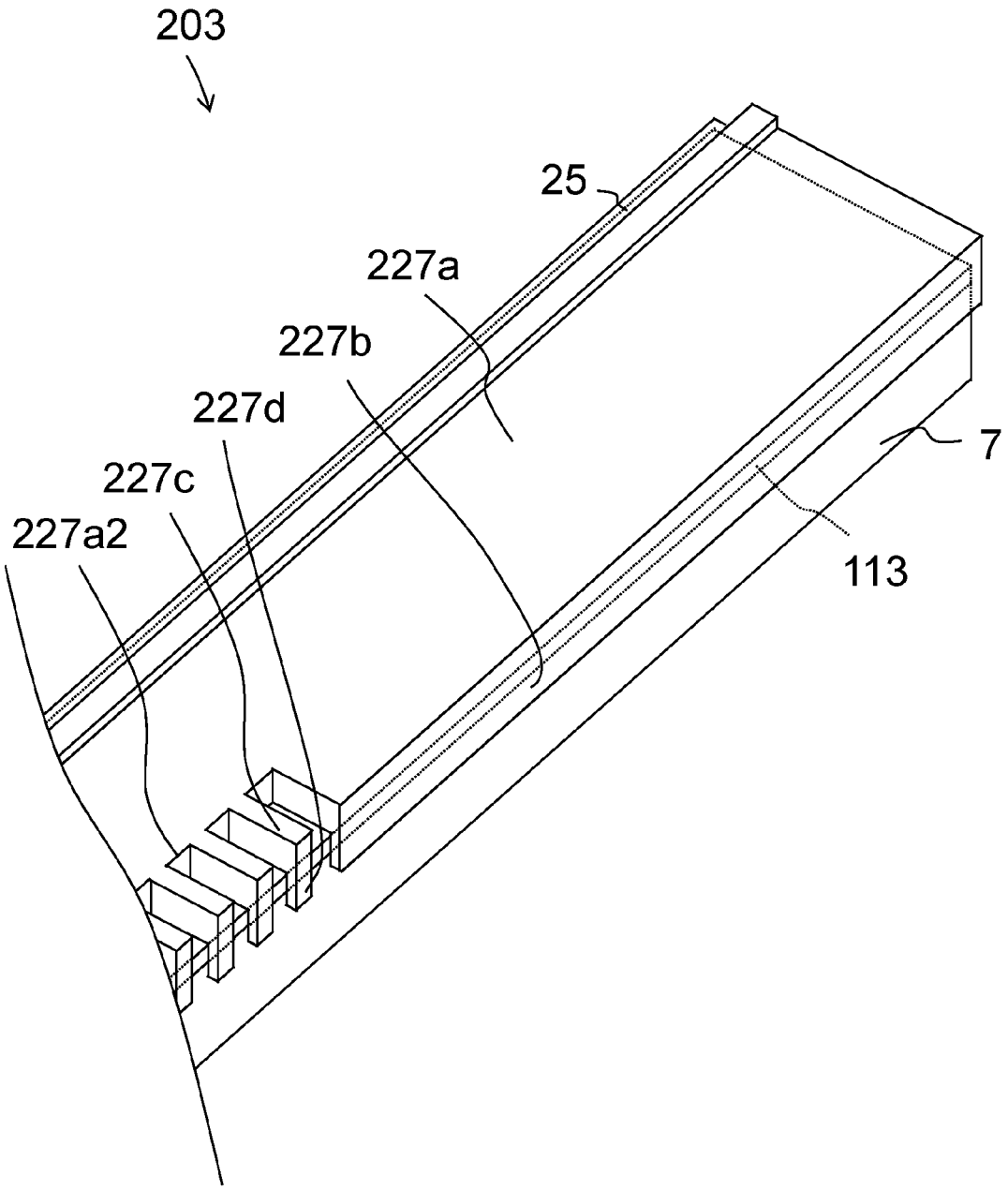
FIG. 10 is a schematic partial perspective view of a head base body of a thermal head according to a third embodiment.
Figure 11A:
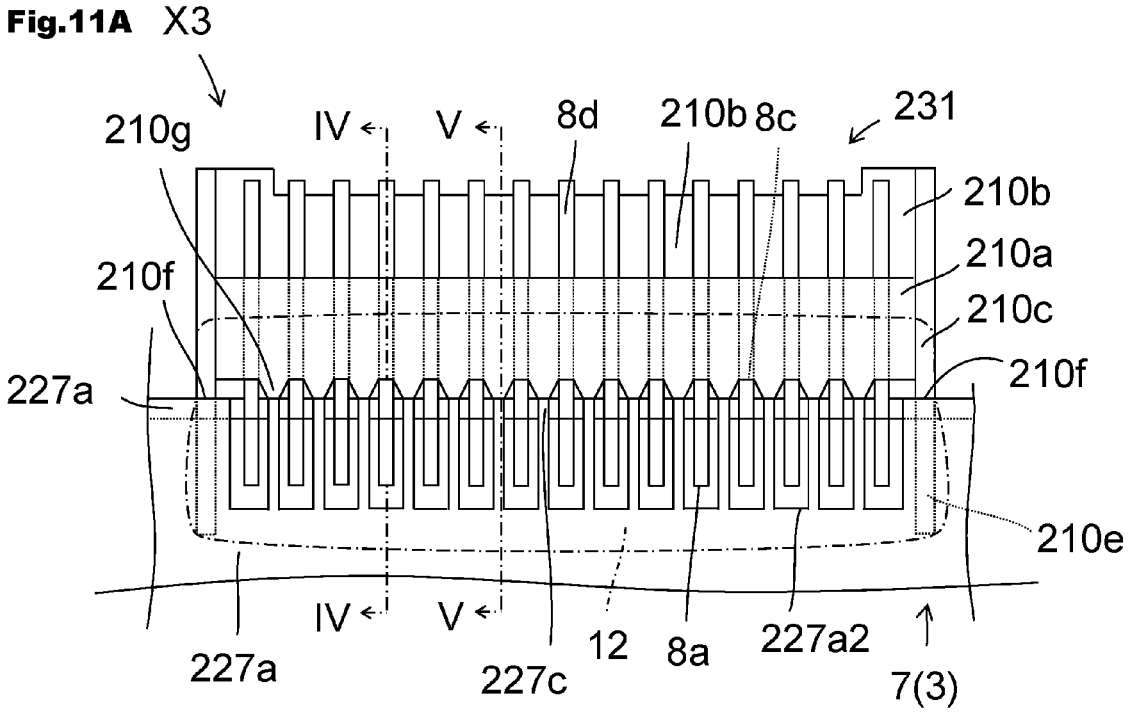
FIGS. 11A and 11B show enlarged views of a region near a connector of the thermal head according to the third embodiment.
Figure 11B:
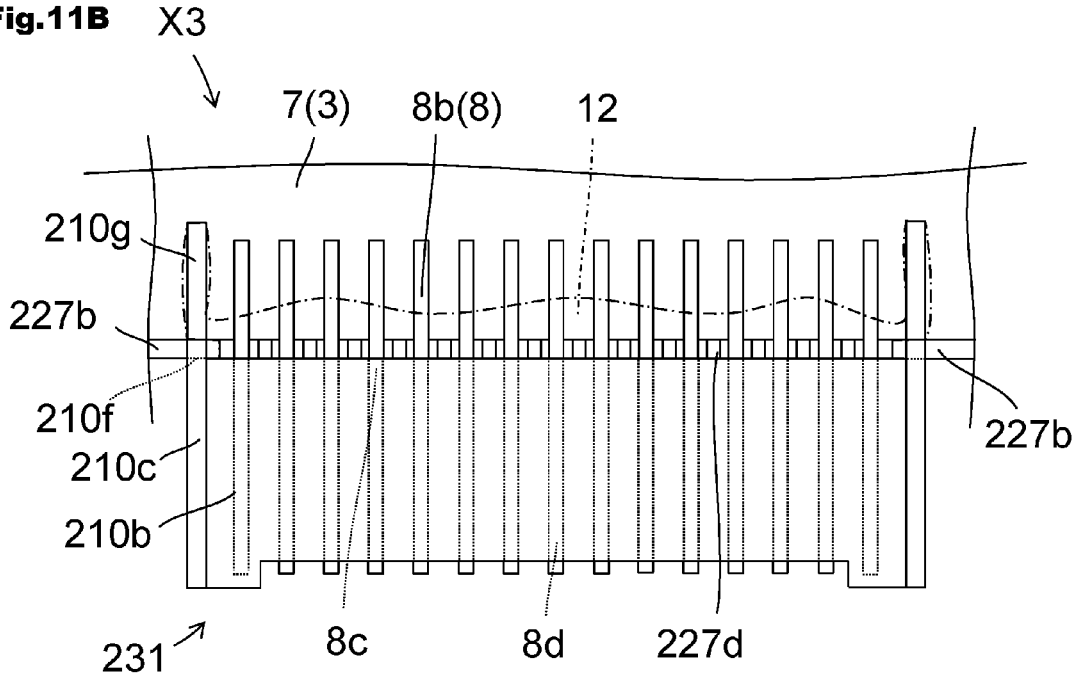
Figure 12A:
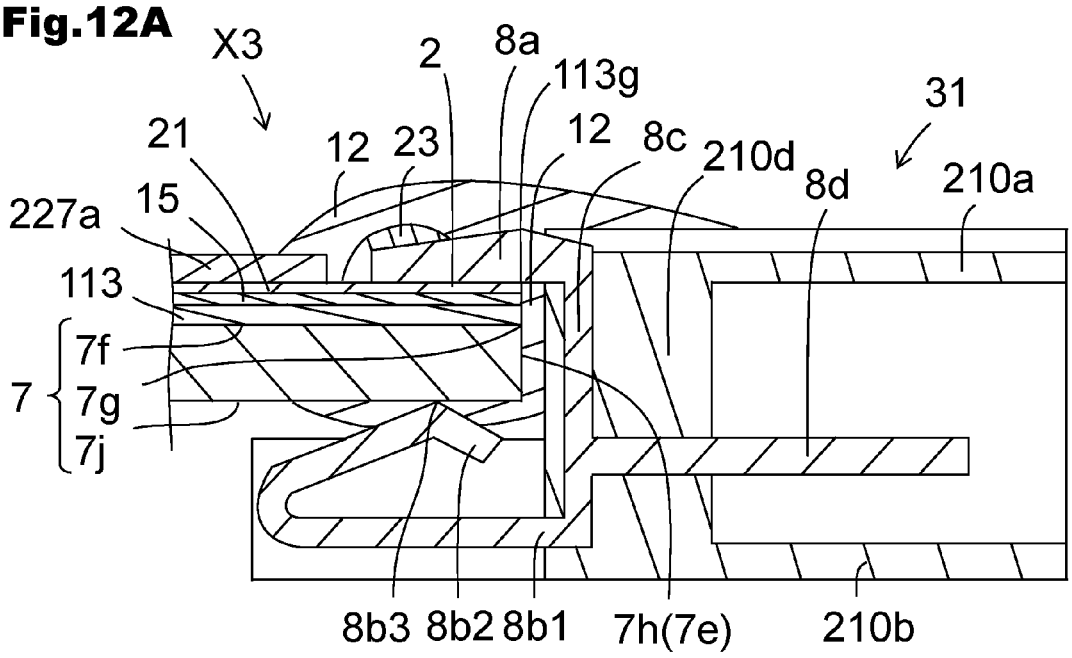
FIG. 12A is a sectional view taken along line IV-IV shown in FIG. 11A.
Figure 12B:
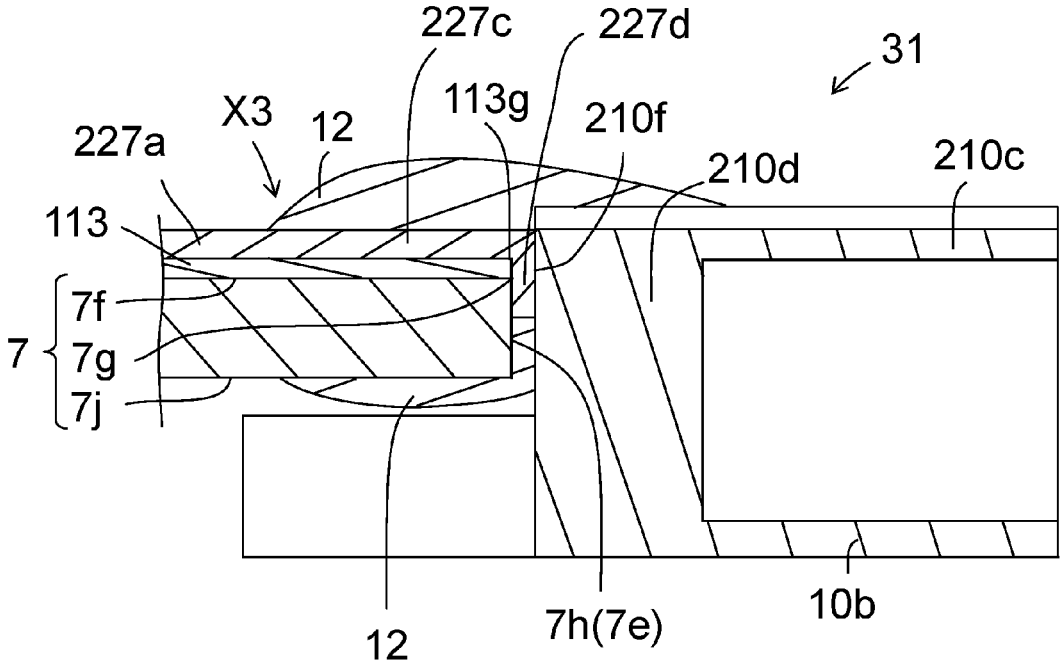
FIG. 12B is a sectional view taken along line V-V shown in FIG. 11A.

Referring to FIGS. 10 to 12, a thermal head X3 will be described. The thermal head X3 differs from the thermal head X2 in the structures of a first covering layer 227*a*, a second covering layer 227*b*, and a connector 231. In other respects, the thermal head X3 is the same as the thermal head X2. In FIG. 10, the drive ICs 11 and the openings 27*a*1 (see FIG. 1) are omitted.

The first covering layer 227*a* has the openings 27*a*1 and openings 227*a*2, is disposed on the first main surface 7*f*, and has the same structure as the first covering layer 127*a* of the thermal head x2. The second covering layer 227*b* extends from the first covering layer 227*a* onto the end surface 7*e* and has the same structure as the second covering layer 127*b* of the thermal head X2.

The first covering layer 227*a* is disposed on the first main surface 7*f* of the substrate 7 and includes first extension portions 227*c*, which extend from the openings 227*a*2 toward spaces between the plurality of first connector pins 8*a*. The first extension portions 227*c* extend to positions near the end surface 7*e* of the substrate 7.

The second covering layer 227*b* includes second extension portions 227*d*, which extend from the first extension portions 227*c* onto the end surface 7*e* beyond an end surface (not shown) of the heat storage layer 113. Therefore, the second extension portions 227*d* are formed so as to be continuous with the first extension portions 227*c*. The second extension portions 227*d* are disposed only on parts of the end surface 7*e* near the first main surface 7*f* so that a part of the end surface 7*e* is exposed.

The thermal head X3 includes the first extension portions 227*c*, which extend toward spaces between the plurality of connector pins 8. Therefore, even if a large amount of the solder 23 is applied to the first connector pins 8, it is possible to reduce the probability of occurrence of short circuit due to solder bridging, which may occur if the flow of the solder 23 is blocked by the first extension portions 227*c*.

The first extension portions 227*c* and the second extension portions 227*d* are formed so as to be continuous with each other. Thus, the second corner 113*g* can be integrally covered by the first extension portions 227*c* and the second extension portions 227*d*, and the probability of chipping of the second corner 113*g* can be further reduced.

As illustrated in FIG. 11, a housing 210 includes an upper wall 210*a*, a lower wall 210*b*, side walls 210*c*, a front wall 210*d*, support portions 210*e*, positioning portions 210*f*, and protrusions 210*g*. Descriptions of the lower wall 210*b*, the side walls 210*c*, the front wall 210*d*, the support portions 210*e*, and the positioning portions 210*f*, which have the same structures as those of the housing 10, will be omitted.

The upper wall 210*a* is disposed so as to face the end surface 7*e* of the substrate 7 in a state in which the upper wall 210*a* is separated from the substrate 7. The upper wall 210*a* includes protrusions 210*g*, which are located between the connector pins 8 and protrude toward the substrate 7.

Therefore, when the covering member 12 is applied from the first main surface 7*f* side, the probability of shortage of the amount of the covering member 12 on the first main surface 7*f* side, which may occur if the covering member 12 flows out from a gap between the upper wall 210*a* and the substrate 7, can be reduced.

Because the second extension portions 228*d* are in contact with the protrusion 210*g*, when inserting a socket into the connector 231, the second extension portion 227*d* can absorb an external force applied to the end surface 7*e*. As a result, the probability of breakage of the end surface 7*e* can be reduced.

In the above example, the first extension portions 227*c* are disposed in every space between adjacent first connector pins 8*a*. However, this is not a limitation. The first extension portions 227*c* may be disposed in spaces between every second pair of first connector pins 8*a* or in spaces between every third pair of first connector pins 8*a*. The second extension portion 227*b* may be disposed in the same way.

Fourth Embodiment

Figure 13A:
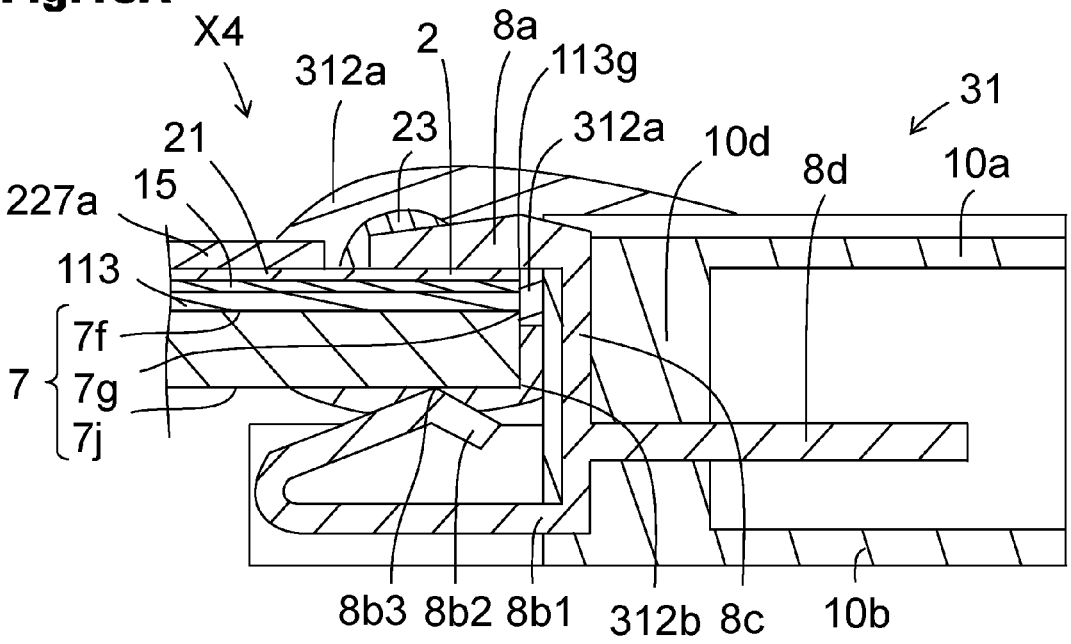
FIGS. 13A and 13B illustrate a thermal head according to a fourth embodiment.
Figure 13B:
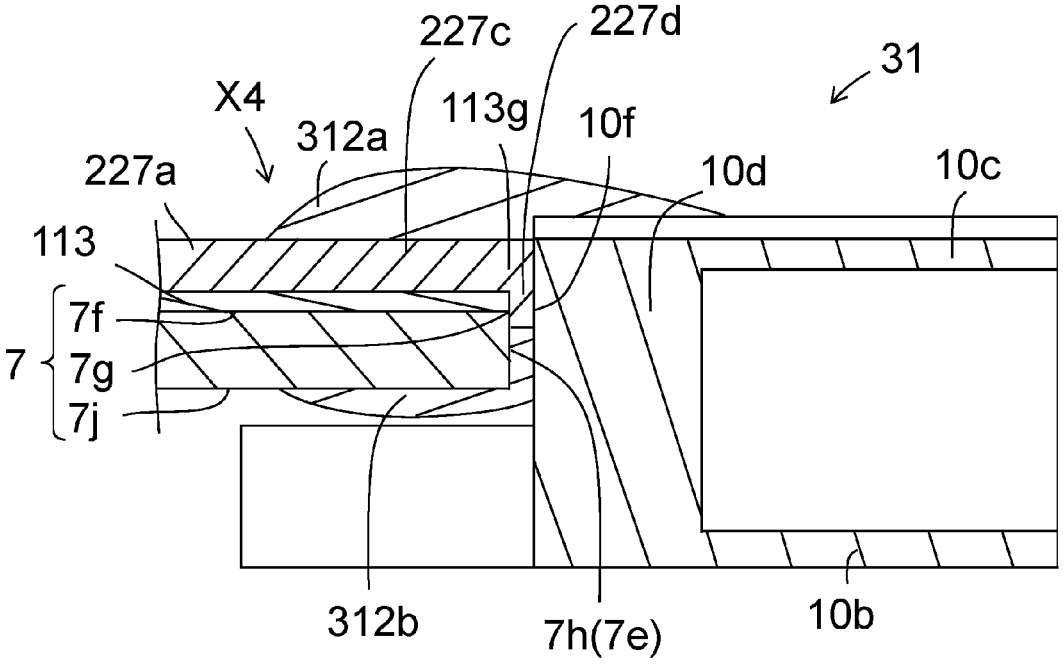

Referring to FIG. 13, a thermal head X4 according to a fourth embodiment will be described. The thermal head X4 differs from the thermal head X3 in the structure of a covering member 312. In other respects, the thermal head X4 is the same as the thermal head X3.

The covering member 312 includes a first covering member 312*a* and a second covering member 312*b*. The first covering member 312*a* is disposed on the first main surface 7*f* side. The second covering member 312*b* is disposed on the second main surface 7*j* side of the substrate 7. The hardness of the second covering member 312*b* is lower than that of the first covering member 312*a*.

The first covering member 312*a* may be made of, for example, an epoxy thermosetting resin. Preferably, the Shore hardness of the first covering member 312*a* is in the range of D80 to 100. Preferably, the thermal expansion coefficient of the first covering member 312*a* is in the range of 10 to 20 ppm at room temperature.

The second covering member 312*b* may be made of, for example, an epoxy thermosetting resin. Preferably, the Shore hardness of the second covering member 312*b* is in the range of D60 to 80. Preferably, the thermal expansion coefficient of the second covering member 312*b* is in the range of 60 to 100 ppm at room temperature.

The hardnesses of the first covering member 312*a* and the second covering member 312*b* can be measured, for example, by using a durometer (type D) compliant with JIS K 6253. For example, the hardnesses of any three portions of the first covering member 312*a* may be measured by using a durometer, and the average of the hardnesses may be used as the hardness of the first covering member 312*a*. The hardness of the second covering member 312*b* may be measured in the same way. The hardness may be measured by using a Shore scleroscope or the like, instead of a durometer.

The thermal head X4 has a structure in which the exposed portion 7*e* and the connector 31 are joined by the second covering member 312*b*. Thus, a portion adjacent to the first main surface 7*f* side, in which the first connector pins 8*a* are disposed, can be securely fixed in place by using the first covering member 312*a*; and a portion adjacent to the second main surface 7*j* can be fixed in place by using the second covering member 312*b* while absorbing a stress.

Thus, even when an external force is applied to the connector 31 due to insertion and extraction of a socket, the second covering member 312*b* can absorb the stress, and the probability of breakage of the covering member 312 can be reduced.

Fifth Embodiment

Figure 14A:
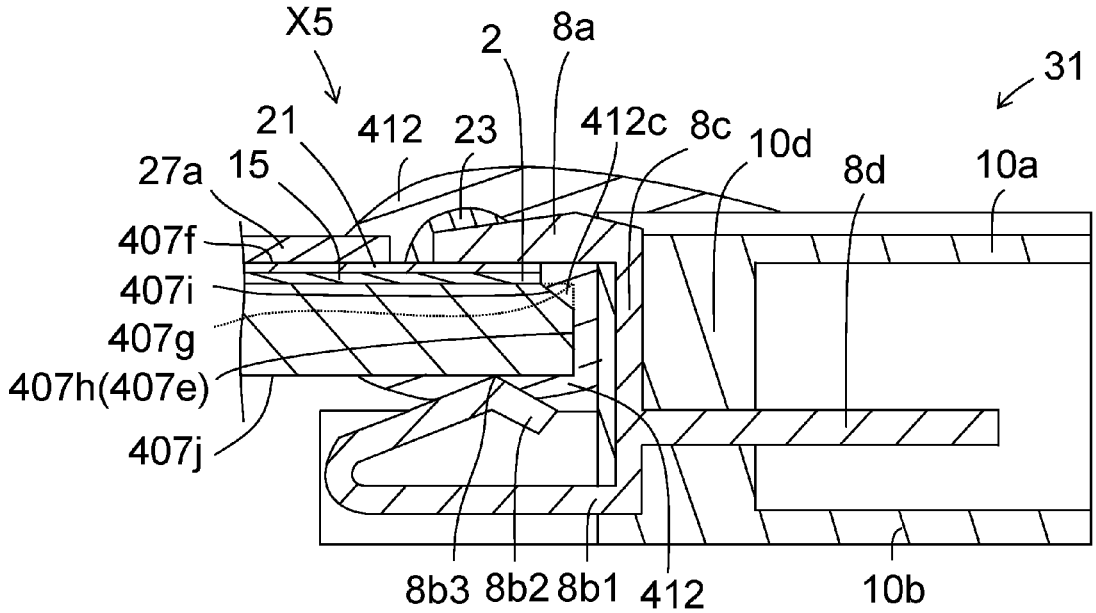
FIGS. 14A and 14B illustrate a thermal head according to a fifth embodiment.
Figure 14B:
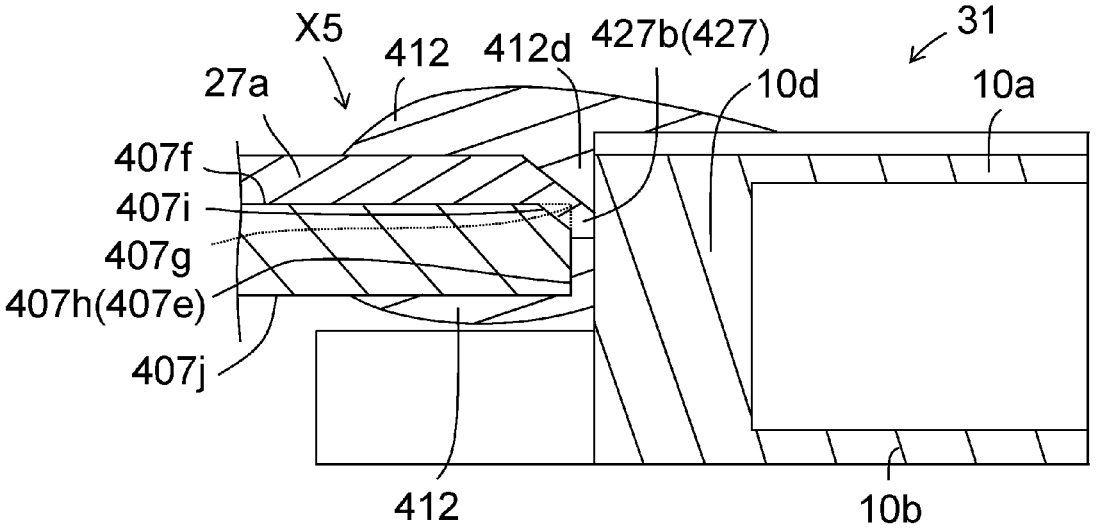

Referring to FIG. 14, a thermal head X5 according to a fifth embodiment will be described. The thermal head X5 differs from the thermal head X4 in the structures of a substrate 407, a first covering layer 427*a*, a second covering layer 427*b*, and a covering member 412. In other respects, the thermal head X5 is the same as the thermal head X4.

The substrate 407 has a first main surface 407*f*, an end surface 407*e*, and an inclined portion 407*i*. The end surface 407*e* is disposed adjacent to the first main surface 407*f*. The inclined portion 407*i* is formed by chamfering a first corner 407*g*, which is formed by the first main surface 407*f* and the end surface 407*e*. Chamfering may be performed by using a known method and may be flat chamfering or round chamfering.

The first covering layer 427*a* is disposed on the first main surface 407*f* of the substrate 407. The second covering layer 427*b* extends from the first covering layer 427*a* to the end surface 407*e* of the substrate 407. Therefore, the second covering layer 427*b* is disposed on the inclined portion 407*i* and the end surface 407*e*. As a result, the inclined portion 407*i* is covered by the first covering layer 427*a* and the second covering layer 427*b*.

The second covering layer 427*b* is disposed on the inclined portion 407*i*, and the covering member 412 is disposed on the second covering layer 427*b* on the inclined portion 407*i*. Therefore, a portion 412*d* of the covering member 412 is disposed on the second covering layer 427*b* on the inclined portion 407*i*.

Thus, the portion 412*d* of the covering member 412 is disposed in the gap between the connector 31 and the substrate 407. As a result, even when the covering member 412 contacts the recording medium P (see FIG. 7), the probability of peeling-off of the covering member 412 can be reduced, because the joint strength of the covering member 412 and the substrate 407 and the connector 31 is large.

The present invention is not limited to the embodiments described above, which can be modified in various ways within the spirit and scope of the present invention. For example, the thermal printer Z1 includes the thermal head X1 according to the first embodiment. This is not a limitation, and the thermal heads X2 to X5 may be used for the thermal printer Z1. The thermal heads X1 to X5 according to the embodiments may be used in combination.

In the thermal heads X1 to X5, the connector 31 is disposed at a central part in the arrangement direction. However, the connector 31 may be disposed at each of two ends of the substrate 7 in the main scanning direction.

Without forming the bulging portion 13*b* in the heat storage layer 13, the heating elements 9 of the resistor layer 15 may be disposed on the base portion 13*a* of the heat storage layer 13.

The heating elements 9 may be formed by forming the common electrode 17 and the individual electrodes 19 on the heat storage layer 13 and by forming the resistor layer 15 only in regions between the common electrode 17 and the individual electrodes 19.

In the above examples, the thermal heads are thin-film heads in which the resistor layer 15 is formed as a thin film and the heating elements 9 are thin. However, this is not a limitation. For example, the present invention may be used for a thick-film head in which thick heating elements 9 are formed by patterning various electrodes and then forming the resistor layer 15 by using a thick-film forming technology. The present technology may be used for an end-surface head in which the heating elements 9 are formed on the end surface 7*e* of the substrate 7. In the above examples, the end surface 7*e* is perpendicular to the first main surface 7*f*. However, the end surface 7*e* may be a curved surface, or a surface that is partially inclined with respect to the first main surface 7*f*.

The covering member 12 may be made of a material that is the same as the sealing resin 29, which covers the drive ICs 11. In this case, the sealing resin 29 and the covering member 12 may be simultaneously formed by printing a region in which the covering member 12 is formed when printing the sealing resin 29.

REFERENCE SIGNS LIST

X1 to X5 thermal head
Z1 thermal printer
1 heat sink
2 connection terminal
3 head base body

7 substrate
7*e* end surface
7*f* first main surface
7*g* first corner
7*h* exposed portion
7*i* inclined portion
7*j* second main surface
8 connector pins
9 heating elements
10 housing
12 covering member
23 solder
25 protective layer
27*a* first covering layer
27*b* second covering layer
29 sealing resin
31 connector

The invention claimed is:

1. A thermal head comprising:
a substrate having a first main surface and an end surface adjacent to the first main surface;
heating elements disposed on the first main surface or on the end surface;
electrodes disposed on the first main surface and electrically connected to the heating elements;
a first covering layer disposed on parts of the electrodes;
a connector adjacent to the end surface, comprising connector pins disposed on the electrodes and a housing containing the connector pins;
a covering member covering the connector pins and the electrodes; and
a second covering layer at least disposed between the first covering layer and an end of the first main surface near the end surface, and
wherein the housing is in contact with the second covering layer.

2. The thermal head according to claim 1,
wherein the housing has a box shape having an opening facing away from the substrate and comprises a front wall adjacent to the substrate and side walls located on both sides of the front wall in a main scanning direction, and
wherein the side walls are in contact with the second covering layer.

3. The thermal head according to claim 1,
wherein the substrate comprises a first corner that is formed by the first main surface and the end surface, and
wherein the first corner is covered by the first covering layer and the second covering layer.

4. The thermal head according to claim 3, further comprising:
a heat storage layer disposed on the first main surface,
wherein the heat storage layer comprises a second corner located on the first corner, and
wherein the second corner is covered by the first covering layer and the second covering layer.

5. The thermal head according to claim 4, wherein a length of the second covering layer in a thickness direction of the substrate is greater than a thickness of the heat storage layer.

6. The thermal head according to claim 3,
wherein the first corner comprises an inclined portion that is chamfered,
wherein the second covering layer is disposed on the inclined portion, and
wherein the covering member is disposed on the second covering layer.

7. The thermal head according to claim 1,
wherein the end surface comprises an exposed portion exposed from the second covering layer, and
wherein the covering member is disposed between the connector and the exposed portion and joins the connector and the exposed portion.

8. The thermal head according to claim 7, wherein a surface roughness of the exposed portion is greater than a surface roughness of the second covering layer.

9. The thermal head according to claim 7,
wherein the substrate has a second main surface opposite to the first main surface,
wherein the covering member comprises a first covering member disposed on the first main surface and a second covering member disposed on the second main surface, and
wherein the second covering member has a hardness lower than that of the first covering member and joins the exposed portion and the connector.

10. The thermal head according to claim 1, wherein an end portion of the second covering layer is covered by the covering member.

11. The thermal head according to claim 1, wherein a thickness of the second covering layer is smaller than a thickness of the first covering layer.

12. The thermal head according to claim 1, wherein the first covering layer further comprises first extension portions, each of the first extension portions disposed between one of the connector pins and another one of the connector pins.

13. The thermal head according to claim 12, wherein the second covering layer further comprises second extension portions extending from the first extension portions onto the end surface.

14. The thermal head according to claim 13,
wherein the housing comprises an upper wall disposed on the connector pins,
wherein the upper wall comprises protrusions located between the connector pins that protrude toward the substrate in a plan view, and
wherein the second extension portions are in contact with the protrusions.

15. A thermal printer comprising:
the thermal head according to claim 1;
a transport mechanism that transports a recording medium onto the heating elements; and
a platen roller that presses the recording medium against the heating elements.

16. The thermal head according to claim 1,
wherein the second covering layer extends from the first covering layer onto the end surface.

* * * * *